US010099841B2

(12) United States Patent
Reinhold et al.

(10) Patent No.: US 10,099,841 B2
(45) Date of Patent: Oct. 16, 2018

(54) DISPENSING DEVICE FOR SOLID PORTIONS AND METHOD FOR DISPENSING SOLID PORTIONS

(71) Applicant: BALDA MEDICAL GMBH & CO. KG, Bad Oeynhausen (DE)

(72) Inventors: Thomas Sowden Reinhold, Münster (DE); Christian Felsner, Bad Oeynhausen (DE)

(73) Assignee: BALDA MEDICAL GMBH & CO. KG, Bad Oeynhausen (DE)

( * ) Notice: Subject to any disclaimer, the term of this patent is extended or adjusted under 35 U.S.C. 154(b) by 343 days.

(21) Appl. No.: 14/405,745

(22) PCT Filed: May 29, 2013

(86) PCT No.: PCT/EP2013/061050
§ 371 (c)(1),
(2) Date: Dec. 4, 2014

(87) PCT Pub. No.: WO2013/182459
PCT Pub. Date: Dec. 12, 2013

(65) Prior Publication Data

US 2015/0151899 A1 Jun. 4, 2015

(30) Foreign Application Priority Data

Jun. 5, 2012 (DE) ..... 10 2012 209 503

(51) Int. Cl.
*B65D 83/04* (2006.01)

(52) U.S. Cl.
CPC ..... *B65D 83/0409* (2013.01)

(58) Field of Classification Search
CPC ..... A61J 1/03; A61J 1/1418; A61J 7/0084; A61J 7/02; B65D 83/04; B65D 83/0409; B65D 83/0454
See application file for complete search history.

(56) References Cited

U.S. PATENT DOCUMENTS 2,119,917 A * 6/1938 Ilsemann ..... A47F 1/10 221/196
2,431,219 A * 11/1947 Zanardo ..... A24F 15/04 221/135

(Continued)

FOREIGN PATENT DOCUMENTS

CH 695452 A5 5/2006
DE 2835580 A1 3/1979

(Continued)

*Primary Examiner* — Gene O Crawford
*Assistant Examiner* — Kelvin L. Randall, Jr.
(74) *Attorney, Agent, or Firm* — Frank J. Bonini, Jr.; John H. A. Earley III; Harding, Earley, Follmer & Frailey, P.C.

(57) ABSTRACT

A dispensing device for solid portions Fk present in bulk having an axis of rotation 2. The dispensing device 1 has (a) a positioning device 3, and b) a retaining device 4, having at least two retaining means arranged coaxial to the axis of rotation for accommodating one solid portion Fk each. The positioning device 3 and the at least two retaining means 5 can be moved relative to one another on paths coaxial to the axis of rotation, such that the positioning device 3 can be oriented in alignment with the retaining means 5 individually during the movement and at least one of the at least two retaining means 5 can be filled with one solid portion Fk each by means of the positioning device 3. Furthermore, the at least two retaining means 5 can be emptied by rotating the retaining device 4 to output the solid portions Fk.

23 Claims, 28 Drawing Sheets

(56) References Cited

Figure 1A:
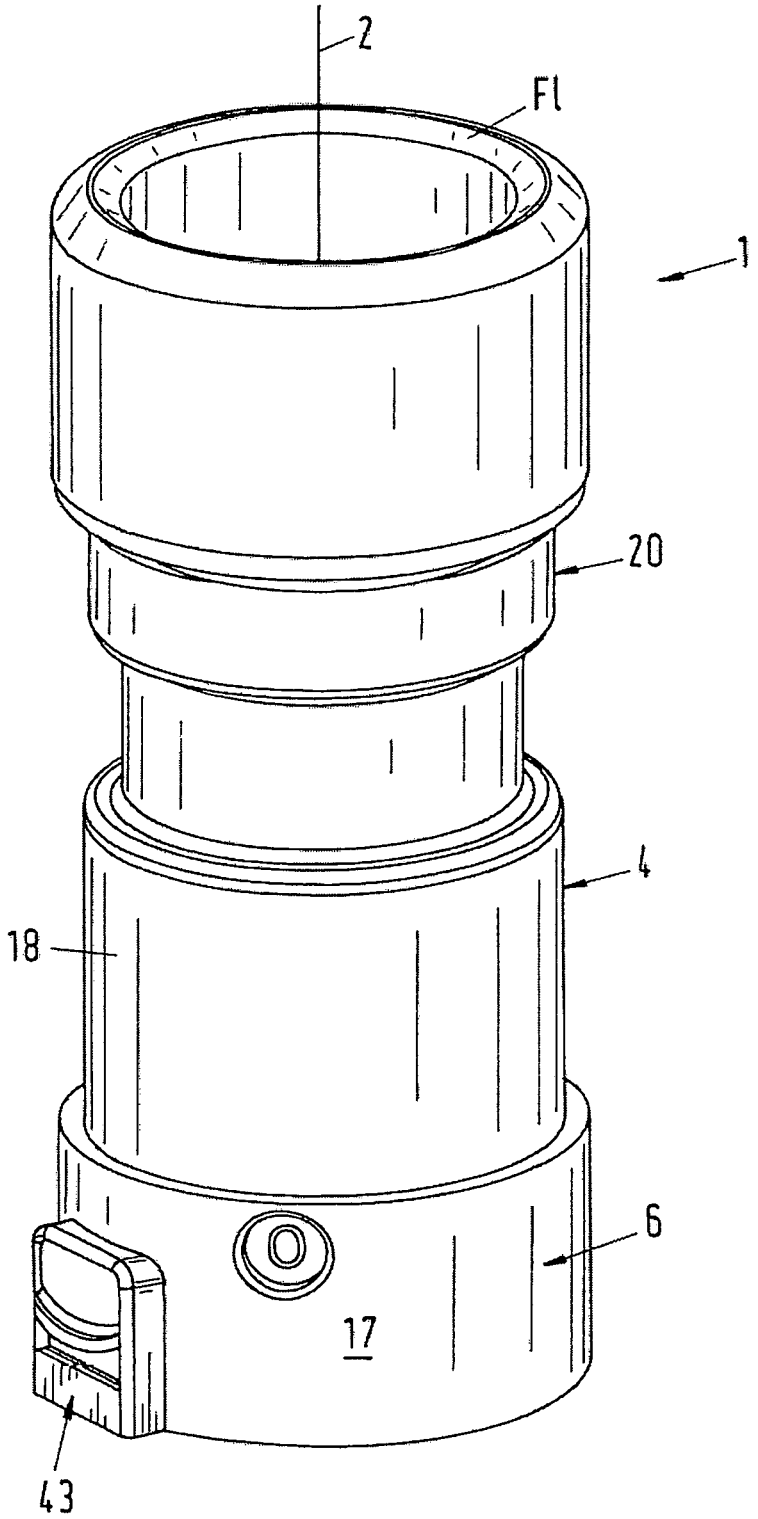

U.S. PATENT DOCUMENTS 2,542,357 A * 2/1951 Reed ..... B65G 47/1471 221/183
2,630,245 A * 3/1953 Maier ..... A47F 1/03 221/264
3,102,662 A * 9/1963 Crabtree ..... B65D 83/0409 221/151
3,527,383 A * 9/1970 Borsum ..... B65D 83/0409 221/112
3,991,908 A * 11/1976 Thomas ..... B65D 83/0409 215/218
4,228,920 A 10/1980 Burton
4,230,236 A * 10/1980 Boulter ..... B65D 83/0409 221/190
4,273,254 A * 6/1981 Cuppleditch ..... B65D 83/0409 221/196
4,653,668 A * 3/1987 Gibilisco ..... B65D 83/0409 206/540
5,323,929 A * 6/1994 Marlar ..... A61J 7/0409 221/121
5,791,515 A * 8/1998 Khan ..... B65D 83/0409 206/533
6,062,423 A * 5/2000 Saito ..... H05K 13/028 221/200
7,097,068 B2 * 8/2006 Limback ..... A47L 15/4409 221/2
7,571,023 B2 * 8/2009 Mitchell ..... A61J 7/02 221/200
7,992,748 B2 * 8/2011 Lawrence ..... G07F 11/54 221/203
2006/0207996 A1 9/2006 Marteau et al.
2007/0145065 A1 * 6/2007 Anderson ..... A61J 7/0076 221/228
2011/0220680 A1 * 9/2011 Danneels ..... B65D 25/04 222/129
2013/0256331 A1 * 10/2013 Giraud ..... A61J 7/0409 221/1
2013/0292406 A1 * 11/2013 Kim ..... B65D 83/04 221/277
2014/0203036 A1 * 7/2014 Bae ..... A61J 7/0084 221/277
2014/0305963 A1 * 10/2014 Zonana ..... B65D 83/0409 221/241
2016/0096675 A1 * 4/2016 Dai ..... B65D 83/0083 221/277

FOREIGN PATENT DOCUMENTS

DE 3302766 A1 8/1984
DE 8709019 U1 9/1987
DE 19909799 A1 9/2000
DE 10339620 A1 3/2005
DE 202004021462 U1 4/2008
EP 0261617 A2 9/1987
EP 0393573 A1 4/1990
EP 2201925 A1 12/2008
FR 2400467 A1 3/1979
WO WO2004103856 A1 12/2004
WO WO2010060568 A2 6/2010

* cited by examiner

DISPENSING DEVICE FOR SOLID PORTIONS AND METHOD FOR DISPENSING SOLID PORTIONS

BACKGROUND OF THE INVENTION

1. Field of the Invention

The present invention relates to a dispensing device for solid portions present in a bulk body and a method for dispensing solid portions. Such devices and methods are used typically for pharmaceutical solid forms of presentation in the form of pharmaceutical product portions, such as tablets, dragees, pills, capsules, globules (spheroids), microtablets, and other forms. The invention can also be used for the dispensing of solid portions for other purposes, such as food supplements, vitamin preparations, and build-up preparations.

2. Brief Description of the Related Art

A dispenser is particularly helpful for the counting of microtablets and globules, which dispenses not only one but even several such solid portions in a defined number and in a controlled manner, such that a predetermined quantity of small-part presentation forms can be separated out and taken by any users, without further ado.

A dispenser for the dispensing of such small-part presentation forms is described, for example, in EP 0 393 573 A1. These dispensers comprise a channel for the orientation of granules, which are intended to be dispensed one after another. This channel is formed by a soft hose, which can be deformed from a circular cross-section into an oval cross-section. The granules form a stack in the hose. In order in the first instance for a granule to be retained, and then dispensed when needed, located in the hose in the dispensing area are lips, which hold a granule firmly and do not release it until the hose is deformed. In order for further granules following after to be retained when the first granule is dispensed, located in the hose, immediately behind the first granule are projections, which retain the following granule when the hose is deformed for the dispensing of the first granule.

In EP 2 201 925 A1 describes a dispenser is likewise described which comprises a reservoir for capsules or pills in the form of several chambers arranged parallel to one another. The chambers are arranged in such a way as to accommodate in each case a stack of capsules or pills. Arranged beneath the chambers is a register wheel, rotatable in relation to these chambers, with an accommodation aperture. At the same time, a dispensing aperture is provided above an outlet aperture in a positioning disk. Due to the fact that the accommodation aperture and the dispensing aperture are not in alignment with one another, only one of these apertures accommodates a capsule or pill from a chamber. The capsule or pill can be conveyed from the dispensing aperture into a connecting channel, wherein the dispensing aperture and the connecting channel together form a guide element. The other of the two apertures is connected to one of the outlet apertures. The outlet apertures are arranged in the same order as the apertures of the chambers, although offset at an angle to one another. The capsule or pill is therefore conveyed to the outlet aperture by the rotation of the guide element.

Described in EP 0 261 617 A2 is a metering dispenser, which is likewise intended for shaped solids, such as tablets and pills in very small format. This dispenser comprises in its interior a metering wheel with metering apertures.

Located beneath the metering wheel is a base part with an output hole, which can be brought into congruence with one of the metering apertures, such that a tablet or pill located therein will be ejected. In order for none of the tablets or pills which are contained in the space above the metering apertures in the dispenser to pass directly through one of the metering apertures directly to the output hole, a tab is located at the corresponding place in the interior, which covers the metering aperture there.

The metering device described in DE 20 2004 021 462 U1 serves to provide uniform and equivalent single metering, individually matched to the patient, of meterable solid pharmaceutical presentation forms. The device comprises a metering container, which contains a pipe piece with portioning areas at its lower edge. The portioning areas are filled individually with the solids contained in the container. They are separated by the rotation of a scraper in the interior and conducted to an ejection aperture in the base of the outer casing of the metering container.

Further disclosed in WO 2010/060568 A2 is a manually-actuated metering device, which comprises in a container a storage chamber and a dispenser area, as well as a feed unit, which connects the storage chamber and the dispenser area. The feed unit serves to provide individual delivery of pharmaceutical units into the dispensing area. The feed unit is formed by a feed wheel with feed pockets, which, on rotation, carries in each case one pharmaceutical unit in the pockets and feeds it to the dispensing area. The feed wheel is electronically rotated in a controlled manner by a motor.

The known devices for the metering of solid pharmaceutical presentation forms and other solids, however, are either not very reliable with regard to the metering of a specific number of solid units, or require substantial expenditure of effort in their manufacture, use, and disposal. In particular, the metering device according to WO 2010/060568 A2 requires an electronic control and a motor drive, in order for the feed unit to be operated. The use and also the disposal after use of this metering device are therefore elaborate and expensive. The problem on which the present invention is based is therefore that the known devices and methods for metering are elaborate and expensive, or not sufficiently reliable.

SUMMARY OF THE INVENTION

One of the objects on which the present invention is based, in particular for the use of small-part solid pharmaceutical forms, such as microtablets, is the determination of a precise number of solid portions (metering precision), in order for a user to be able to take the pharmaceutical product in the required quantity. Such small-part solid pharmaceutical forms are well-suited, inter alia, for an individual pharmaceutical treatment of persons, in that, depending on the nature and severity of their disorder, the personal circumstances and physical characteristics of the user, for example children, and other parameters, a plurality of portions of pharmaceutical are issued for an individual medication. This quantity determination and provision must also still be possible with no problem if the patient is only capable to a restricted degree of counting out the solid portion for themselves. A further object of the present invention is the provision of a dispensing device which is relatively less elaborate and expensive in manufacture, maintenance, use, and disposal.

These objects are solved by the dispensing device according to the claims. Preferred embodiments of the invention are described in the subclaims.

Inasmuch as the terms "solid portion" or "solid portions" are used hereinafter in the invention description and in the claims, these are to be understood as pills, dragees, capsules, tablets, including microtablets, granulates, and other solid presentation forms. Such portions may, for example, have a mass of at least 1 mg, preferably of at least 3 mg, for further preference of at least 4 mg, and for greatest preference of at least 5 mg. In addition, these portions may have a maximum mass of 10 mg, preferably of 50 mg, for further preference of 10 mg, and for greatest preference of 7 mg. Shaped solid portions may have, for example, a diameter of 1-3 mm, in particular of approximately 2 mm. The portions may be present as shaped or in the form of granulates. In the case of shaped solid portions, they may be spherical, ellipsoid, cylindrical, if appropriate with rounded edges. The solid portions can be used for pharmaceutical purposes, including for homeopathic applications, as well as food supplements, vitamin preparations, build-up preparations, preparations for protein provision, and other such areas of application. Pharmaceutical preparations which can be metered with the dispensing device according to the invention can be used in particular in the paediatric sector. Microtablets can be metered with the dispensing device according to the invention, for example, as a function of the body weight of the patient (personalised medication).

Inasmuch as hereinafter and in the claims the spatial orientation is given of a component of the dispensing device according to the invention, or of the dispensing device itself, this relates to an alignment of the dispensing device in which it is ready for the issue of solid portions; i.e. an application aperture is located at the lower end of the device, and an adapter, provided if appropriate for the connection of a primary packaging means for the solid portions, is located at the upper end of the device, unless expressly indicated otherwise.

Inasmuch as terms are used hereinafter in the description and in the claims which designate in particular structural elements of the object according to the invention, such as "retaining means" and the like, these terms, regardless of whether used in the singular or plural, are to be understood as being both in the singular and in the plural.

The dispensing device according to the invention serves to issue solid portions. These pass in bulk into the dispensing device, and are then present in a bulk body in the dispensing device. The dispensing device preferably exhibits an axis of rotation. This dispensing device comprises (a) a positioning device and (b) a retaining device, with at least one retaining means, preferably with at least two retaining means, for accommodating in each case a solid portion. Preferably, the at least one retaining means or the at least two retaining means can be arranged coaxially to the axis of rotation. The positioning device and the at least one retaining means can be moved relative to each other, preferably on paths coaxial to the axis of rotation, such that the positioning device and the at least one retaining means can be aligned in alignment with one another, and the at least one retaining means can be filled by means of the positioning device in each case with a solid portion. Furthermore, the at least one retaining means can be emptied, for the issue of the solid portions, by a movement, preferably a rotation, of the retaining device.

Instead of a dispensing device exhibiting an axis of rotation, a dispensing device can also be provided which, in addition to a positioning device, contains a retaining device, for example in the form of a sliding element, wherein the retaining device comprises one or more retaining means, lying, for example, in a row one behind another, wherein the retaining device is formed opposite the positioning device for the carrying out of a linear movement. In order to transfer a solid portion into a retaining means, the retaining device can be moved, for example, in a linear movement opposite the positioning device. If the retaining device comprises only one single retaining means, the retaining device can be moved backwards and forwards in each case for the issue of a solid portion.

The method according to the invention serves to dispense at least one solid portion from several solid portions present in the bulk body, by means of a dispensing device, preferably by means of the dispensing device according to the invention. The method comprises the following method steps:

(a) Positioning the solid portions at a discharge location by means of the positioning device, (b) Transferring of at least one solid portion from the discharge location in each case of an at least one, and preferably of at least two, retaining means in the retaining device, by moving the positioning device and the at least one retaining means relative to each other, preferably on paths coaxial to an axis of rotation of the dispensing device, and (c) Issuing of the at least one solid portion from the dispensing device by movement, preferably rotation, of the retaining device, such that the at least one retaining means is emptied.

By means of the positioning device the solid portions are first arranged, from a form of solid portions present in the bulk body, into an orientation in relation to one another which is suitable for the subsequent individual separation, such that they are brought individually to an outlet point, from which they can be conducted individually to the retaining means. It is therefore not necessary, as is the case, for example, with the dispenser from EP 2 201 925 A1, for the capsules or pills to be filled in an elaborate manner by hand into the chambers. With the aid of the positioning device according to the present invention, the solid portions are first conveyed into geometric positions in relation to one another, from which they can be transferred one after another and individually to the retaining means. The geometric arrangement of the solid portions is produced automatically by the positioning device, without any other manual intervention being necessary. By way of this arrangement, a reliable filling of the retaining means with a solid portion is achieved in each case. Only when this arrangement of solid portions in relation to one another has been attained can the one solid portion be conveyed into a retaining means, such that a reliable issue from the retaining means is ensured. With the dispensing device according to the invention it is guaranteed that every retaining means is filled with exactly one solid portion. Inasmuch as the retaining means are arranged in line one after another onto the positioning device, it is further guaranteed that the solid portions arranged in this way in relation to one another will also pass individually into the retaining means. The coaxial arrangement and movement of the retaining means and of the positioning device on a circular path coaxial to the axis of rotation allows for a simple design solution for the sequential filling of the retaining means from the positioning device. To fill the retaining means, all that is required is a relative movement at the dispensing device. In the same way, the filled retaining means can then also be emptied again, in order to dispense the solid portions contained in them. The dispensing device according to the invention can therefore be actuated by simple manual action. A motor drive as with WO 2010/060568 A2 is not required, with the result that the production, operation, maintenance, and disposal of the dispensing device is simple and economical.

In a preferred further embodiment of the present invention, the positioning device is formed by a positioning shaft, into which the solid portions can be received from the bulk body, and in which, for example, a column of individual solid portions stacked above one another can be formed (in which the solid portions are arranged in a row). This shaft extends along a path running from top to bottom, such that the solid portions contained in it are advanced by gravity when, at the lower end of the shaft, namely at the outlet point, a portion is moved forwards into one of the retaining means. The shaft can be easily filled with a bulk body. For this purpose, the solid portions are introduced from the bulk body into the shaft. In particular, the shaft can be formed in such a way that in each case only individual portions stacked above one another are taken up, namely in a head-end arrangement of adjacent (located above one another) portions. For this purpose, the shaft cross-section is dimensioned in such a way that always only one solid portion can fall into the shaft, and a further solid portion lies on the portion which precede's it. In the shaft, the portions form into an organized buffer. The solid portions are then conveyed from a stack forming a column in this way, one after another into the retaining means. The shaft may exhibit a cross-section which quadrilateral, preferably square, or round, for example circular.

The positioning shaft can be formed in the manner of a channel inside a component part of the dispensing device according to the invention, or by a trough at or in the wall, or by a gap in the wall of a first component part and a wall of a second component part, which encloses the trough. For example, the second component part can be the retaining device. The trough is then formed in common by two component parts of the dispensing device. The positioning shaft extends between an inlet aperture in the upper area and an outlet aperture (output point) in the lower area. Between these two areas the shaft may run straight or with a bend, or formed from a combination of a straight and bent course.

In a further preferred embodiment of the invention, the retaining device can be formed in such a way as for the solid portions to be held above the positioning device in a storage space in bulk form, i.e. the positioning device in this case is arranged beneath the storage space. Accordingly, the solid portions can be simply poured into the storage space of the dispensing device, and form the bulk body there. For example, the dispensing device can be connected by an adapter to a conventional primary packaging means for the solid portions, such a bottle or tube, in which the portions are provided to the user, possibly in that the dispensing device is screwed onto the top of the primary packaging means, or snapped into place on it, or otherwise secured to it, and the solid portions then fall out of the packaging means into the storage space and form the bulk body there. The positioning device opens into this area preferably directly into the storage space, such that the solid portions pass out of the storage space directly into the positioning device. The storage space can be dimensioned for this purpose such as to accommodate the entire quantity of solid portions which are present in the packaging means. It is advantageous, however, for the size of the storage space to be dimensioned smaller if the dispensing device can be connected to the packaging means, since the dispensing device in this case only has the task of dispensing the solid portions in individual form, but not storing them. The solid portions are in this case essentially held in the primary packaging means.

In a further preferred embodiment of the invention, an infeed space is located above the inlet aperture into the positioning shaft. This infeed space is preferably a part of the storage space. In the infeed space, the solid portions are already arranged and organized before entering into the positioning device, for example by being channeled to the positioning device, such as by narrowing the cross-section of the infeed space in the direction onto the positioning device. In a further preferred embodiment of the invention, the infeed space can be formed by an annular gap above the positioning device. For this purpose, in addition to a first wall surface, a second wall surface is provided, located opposite the first and arranged coaxially to it. The annular gap is formed between the two wall surfaces, wherein the first wall surface can be formed by the retaining device. If the dispensing device is not arranged such as to separate the solid portions by the rotation of the retaining device opposite the positioning device, but by means of another type of movement, for example by a linear movement, this gap can be formed in an appropriate manner, in the case of a linear movement, by a gap running in a straight line. The two wall surfaces can run parallel to one another. The gap, such as an annular gap, with, for example, a constant gap width, such as an annular gap width, has the effect of the solid portions already being pre-arranged and organized before entering the positioning device. For example, the width of the gap can be dimensioned in such a way that the solid portions can only be accommodated in it in one layer. From this is derived a structure for the portions which favours the positioning process. As an alternative, the annular gap can also be characterised by a width which varies at least in the axial direction. For example, the annular gap can taper downwards, such that the solid portions are already organized by the tapering downwards in a suitable manner, in that only a single-layer sheet of solid portions can form at the lowest point.

The infeed space or storage space is preferably formed facing downwards in a funnel shape, in order to be able to feed the solid portions into the shaft. If the infeed space is formed in the shape of a gap/annular gap, its floor surface can be formed so as to slope away towards the positioning shaft, such that the infeed space is formed as narrow and funnel-shaped. In particular, the floor surface of the infeed space can have a height level rising from the inlet aperture. For example, the floor surface can exhibit, on the side of the infeed space located opposite the inlet aperture into the positioning shaft, a highest level, and a lowest level in the area of the inlet aperture. If the infeed space is not formed in the shape of a gap/annular gap, its floor area can also be formed falling away in three-dimensional funnel fashion to the inlet aperture, i.e. the floor surface of the infeed space falls, for example, essentially conically towards the inlet aperture.

In a further preferred embodiment of the invention, the retaining device is profiled at least in the area in which it forms a wall defining the storage space; such as a wall with a wall inner side and/or a wall outer side, with which the solid portions are in contact. As a result, a movement, in particular a rotation or a linear movement, of the retaining device in relation to the positioning device, movement pulses will be transferred by the wall defining the storage space, in particular the wall inner side and/or wall outer side of this wall, onto the solid portions in contact with it. Specifically, with a rotation of the retaining device, this profiled wall slides along the solid portions in contact with this/these wall side(s). The profiling has the effect that the portions with a movement component perpendicular to the wall are defected out of their position of rest, and adjacent portions are then moved in sympathy. As a result, the bulk body is transferred by the rotation into an oscillating or vibrating movement, with the consequence that the solid portions are fed more easily through the inlet aperture into the positioning shaft. As a result, a continuous flow of solid portions into the positioning device is brought about. In particular, the formation of bridges of solid portions in the immediate area of the inlet aperture is prevented, such that, when the buffer of solid portions in the positioning device is at least partially used up, further solid portions are delivered into the positioning device without further ado.

This profiling can be achieved, for example, by a corrugated or wave structure transverse to the direction of rotation, or a corrugation at an angle ≠90° to the direction of rotation, or by knob-like protrusions or by another profiling or roughing, including a combination of the profile types referred to. If the retaining device forms an outer wall of the infeed space, the profiling is then formed on the inner wall side of the retaining device. Conversely, i.e. with the formation of an interior wall side in the infeed space by the retaining device, the profiling can be applied on the outside of the retaining device. The profiling extends preferably over the entire height of the infeed space or storage space, and, if appropriate, beyond this upwards and/or downwards. For example, the profiling can also extend into the area of the positioning shaft, if the retaining device forms a wall surface of the positioning shaft. As a result, the solid portions located in the positioning shaft are likewise set into a vibrating motion by the profiling upon the rotation of the retaining device.

In a further preferred embodiment of the invention, the at least two retaining means of the retaining device are formed in each case by an accommodation aperture, which, depending on the relative position of the retaining device to an output device, can be closed downwards by means of the output device, or is open downwards through an application aperture in the output device, wherein the retaining device can be rotated in relation to the output device and the positioning device. The positioning device and the output device are preferably not rotatable in relation to one another. The solid portions therefore then fall into the accommodation apertures and are held there if a floor surface of the output device is located beneath which closes off the accommodation apertures downwards. Only when the retaining device with its retaining means is rotated in relation to the output device, such that the accommodation apertures are in alignment with one another or simultaneously with the application aperture in the output device, do the solid portions fall through the accommodation apertures and through the application aperture out of the dispensing device. In order for the solid portions to be able to fall through the accommodation apertures, in this embodiment of the invention the apertures are larger than the portions. The application aperture can be approximately the size of an accommodation aperture, or substantially larger. In the former case, the accommodation apertures are emptied individually one after another, in that the apertures are brought into congruency with the application aperture one after another. In the latter case, at least one group of accommodation apertures can be emptied simultaneously. In principle, several application apertures can be provided in the output device, wherein these are then preferably arranged in the same order as the accommodation apertures, such that several accommodation apertures can simultaneously be brought into congruency with several application apertures. The at least one application aperture preferably opens outwards, so that the solid portions can be received by the user after passing through the application aperture, i.e. falling into the user's hand or a glass or another receptacle. In principle, an intermediate storage compartment can also be provided on the dispenser according to the invention, into which the portions emerging through the application aperture fall, and from which the user removes the dispensed portions. Preferably the retaining device comprises at least 2 retaining means, for further preference at least 8, for still further preference at least 12, and for greatest preference at least 16. For further preference, the retaining device comprises a maximum of 80 retaining means, for further preference a maximum of 40, for still further preference a maximum of 30, and for greatest preference a maximum of 25. By way of example, the retaining device can comprise 20 retaining means.

In a further preferred embodiment of the invention, the retaining device is rotatable in relation to the other component parts of the dispensing device according to the invention. As a result, the retaining means can be brought one after another into congruency with the positioning device, in particular with outlet aperture of a positioning shaft, such that the solid portions fall one after another into the retaining means and remain lying therein. The retaining means are preferably brought into congruency with the outlet aperture in a plane beneath the outlet aperture of the positioning device. For the filling of the retaining means, the retaining device is rotated in a filling direction of rotation. On the rotation of the retaining device in the opposite direction of rotation, namely in the outlet direction of rotation, the retaining means once again pass under the positioning device, such that, in the event that, unintentionally, no solid portion has fallen into a retaining means, the possibility once again pertains that a portion can be subsequently delivered into this retaining means, which up to now has been free. Retaining means moved past the positioning device, during the rotation of the retaining device in the outlet direction of rotation, then pass by the application aperture in the outlet device, such that the portions contained in the retaining means then fall out. For this reason, the positioning device, in particular the outlet aperture (outlet point) of a positioning shaft, and the application are spatially arranged fixed in relation to one another: The application aperture is displaced in the outlet direction of rotation in relation to the positioning device, such that a retaining means can first be moved in the filling direction of rotation to the positioning device in order to be filled, without the solid portions, after the filling from the positioning device into the retaining means, moving past the application aperture during this rotational movement. The retaining device can then be rotated in the output direction of rotation, In order for the retaining means to reach the application aperture, to be emptied there. During this rotational movement, and before reaching the application aperture, the retaining means pass the positioning device a second time, such that any still unfilled retaining means can still be filled.

In order to preset the degree of filling of the retaining means with a preselected number of solid portions, the dispensing device can comprise a setting device with an indexing means. This setting device is designed in such a way that the retaining device is only rotatable in the filling direction of rotation so far that the desired number of solid portions pass into the retaining device. For example, the setting device can, by way of the indexing means, restrict the rotation range of the retaining device in the filling direction of rotation. For this purpose, the setting device can form an adjustable stop for the retaining device, such that the retaining device, depending on the setting of the setting device, for example the rotation setting, or of the indexing means respectively, can only be rotated as far as the stop.

In order then to be able to recover the distance covered by the rotational movement of the retaining device in the filling direction of rotation, in the opposite output direction of rotation, apart from an initiation of the backwards movement, without further manual intervention, provision is made in a further embodiment of the present invention for an elastic element, such as a spring, in particular a helical spring, against the pre-tension of which the retaining device can first be rotated in the output direction of rotation. Accordingly, by means of the elastic element, the retaining device can first be rotated, in the filling direction of rotation, into a pre-tensioned rotational position. In this situation, at least one of the at least two retaining means is filled in each case with a solid portion. The pre-tension of the elastic element is then exploited in order to rotate the retaining device back from the pre-tensioned rotation position into a rotation position in which the elastic element is again relaxed. During this rotational movement in the output direction of rotation, the solid portions located in the at least two retaining means are discharged from the dispensing device. The elastic element is supported on a component part in the dispensing device according to the invention, against which the retaining device is rotated, for example against a support panel, which can also serve as a dispensing device and which is secured such as not to rotate in relation to other non-rotatable components, or against a feed element, which is likewise secured so as not to rotate against the other non-rotatable components. As a result of the rotational movement of the retaining device incurred by the elastic element in the output direction of rotation, an accelerated and uniform rotational movement at output is achieved. This leads to a relatively rapid release of the solid portions from the dispensing device, such that all the portions to be issued can be dispensed within a short period of time, and all at the same location, landing for example in the hand of the user or in a glass.

In a further preferred embodiment of the present invention, the dispensing device comprises, in order to render uniform the rotational movement of the retaining device, in particular in the output direction of rotation, at least one movement damper, such as a rotation damper. By means of the rotation damper, the spring-driven rotational movement in the output direction of rotation is damped. The rotation damper has the effect that the rotational movement forced by the pre-tensioned elastic element is slowed, such that the portions are output relatively slowly from the retaining device. Even if the torque of the rotation in the output direction is increased, the speed of rotation only increases insubstantially, due to the damping. As well as this, with the reduced speed of rotation the effect is also achieved that solid portions, which it is intended should fall into still unfilled retaining means, have sufficient time to pass into the retaining means. Otherwise, there would be the risk that the solid portions might remain jammed in the area of the transition between the positioning device and the retaining means, while the retaining device is already moving further in the output direction of movement. As a result, the rotation could be blocked, or the jammed solid portions even destroyed, or possibly not all the retaining means filled. The damper also has the further task of delaying the rotation of the retaining device during tensioning. This also advantageously leads to the filling of the retaining means with the at least one solid portion is ensured. By means of the at least one damper, therefore, the metering precision is again enhanced.

The movement damper, preferably a rotation damper, can be a conventional component, which exercises a dampening effect, for example, on a rotational movement. The damper can be formed, for example, by a viscosity damper. As an alternative, the damper can also be formed as a gear element, in particular with a flywheel (inertial mass), such that a force imposed on the primary side takes effect against the mass inertia by transfer to the secondary side. For example, the viscoelastic property of viscous oils, such as silicone oils, can be exploited in order to move two adjacent surfaces against one another in a damped manner, in that the gap between the surfaces is filled with oil. The rotation damper, like the elastic element, can be held at a component which is held torsionally resistant in the dispensing device. Its rotating part can be connected in a torsionally resistant manner to the retaining device, such that the torque taking effect on the retaining device is reduced by the damping effect of the rotation damper.

The rotation of the retaining device in the output direction of rotation can further be blocked by latching detent elements, in order to be able to initiate the rotation in this direction of rotation separately. To do this, the retaining device can latch-engage with a non-rotatable component of the dispensing device, for example with an operating element suitable for this purpose, wherein the operating element is secured, for example, to the output device. The initiation, and therefore unlocking of the block, can be put into effect by means of the operating element, which suspends the engagement, such that the retaining device can rotate by itself under the effect of the elastic element in the output direction of rotation.

To secure the location of the dispensing device, provision can be made in a further embodiment of the present invention for a filling tilting securing arrangement, which has the effect that the rotation of the retaining device is only possible if the dispensing device is essentially held in an output orientation. As a reference for the output orientation, in particular, the orientation of the application aperture relative to the retaining means can be taken, which should essentially (for example, ±30° to gravitational normal) be located beneath a retaining means when this is brought into congruency with the application opening. With an essentially rotation-symmetric dispensing device with an axis of rotation, this axis of rotation should likewise be oriented within the tilting tolerance indicated (for example, ±30° to gravitational normal). The filling tilting securing arrangement guarantees that the solid portions are transferred out of the storage space or feed space into the positioning device, and from there fall into the retaining means. With a tilting of the dispensing device over the tilting tolerance, the transfer of the at least one solid portion into the retaining means would no longer be guaranteed. The filling tilting securing arrangement can be formed, for example, by balls running on paths, wherein these paths are inclined against the gravitational horizontals with the dispensing device held within the tilting tolerance. The balls block the rotational movement of the retaining device in the event of the dispensing device being tipped in relation to the normals. For this purpose, several balls may be provided in the space on differently-inclined paths, which, depending on the tilting direction, run in the space on paths out of a position of rest, and can block the rotational movement separately. Depending on the orientation of the dispensing device, the balls are in their respective positions of rest, in which the retaining device is freely rotatable if the dispensing device is held perpendicular within the tilting tolerance, or run to other positions on the respective paths, such that the rotation of the retaining device is blocked in the last position if the dispensing device is tilted beyond the tilting tolerance.

Moreover, in another embodiment of the present invention, the dispensing device according to the invention can comprise an output tilting securing arrangement, which prevents the at least one solid portion which has passed into the retaining means from being conveyed back into the positioning device due to the dispensing device being tilted out of the normals, and therefore not being dispensed. In this case, the tilting tolerance can be somewhat greater than with the filling tilting securing arrangement (for example, ±45° to gravitational normals). The output tilting securing arrangement preferably blocks the operating element, which serves to initiate the rotation of the retaining device in the output direction of rotation. The output tilting securing arrangement, like the filling tilting securing arrangement, can be formed by balls on one or more inclined paths, which, depending on the orientation of the dispensing device out of its position of rest in which the operational element is unsecured, if the dispensing device is held perpendicular within the tilting tolerance, run to other positions on the path and block the operating element in the last positions, as soon as the dispensing device is tilted beyond the tilting tolerance.

In a further preferred embodiment of the invention, the positioning device is formed by a trough at or in the outer side or by a gap in the outer wall of a feed device, and an inner side, closing the trough or the gap, of a metering housing accommodating the feed device rotatably within it and forming the retaining device. The metering housing can be rotated in relation to the other component parts of the dispensing device, in order to be able to fill the retaining means contained in it by means of the positioning device and empty them again via the application aperture. In addition, the at least two accommodation apertures in the metering house are arrayed along an orbit running coaxially to the axis of rotation, for example equidistant from one another. These accommodation apertures form the retaining means for the solid portions which it is intended should be dispensed. The at least two accommodation apertures, depending on the position of the retaining device in relation to an application housing, can be closed downwards by means of the application housing, or be open downwards through an application aperture in the application housing. The application housing forms the output element of the dispensing device. By manual rotation of the metering housing with its accommodation apertures in the filling direction of rotation, the accommodation apertures are brought one after another into congruency with the positioning shaft, such that solid portions, which are located in the shaft, fall one after another into the accommodation apertures. For this purpose the metering housing is rotated manually so far that the desired number of solid portions are filled into the retaining means. All other retaining means remain unfilled. By subsequent rotation of the metering housing in the opposing direction of rotation (output direction of rotation), the filled accommodation apertures are moved one after another over the application aperture, such that the solid portions contained in them fall out. By suitable rotation about a fixed angle range, only a predetermined number of solid portions are transferred into the corresponding accommodation apertures, such that subsequently it is also only these portions which are dispensed. Other accommodation apertures remain unfilled. The metering housing can be operated from outside for the purpose of manual rotation.

The metering housing can in particular be pre-tensioned by a helical spring, wherein the spring is supported in the application housing. The pre-tension of the helical spring caused by rotation in the filling direction of rotation leads to automatic rotation in the back direction (output direction). In order to compensate for this rotation, a rotation damper is also provided for, which, like the helical spring, is supported with its fixed part at the application housing, and its rotating part is connected to the metering housing. The metering housing can preferably be blocked in relation to the application housing by means of a tooth arrangement (ratchet) against a rotational movement in the output direction of rotation. This blocking can be suspended by means of an operational element.

In a preferred further embodiment of this first design variant of the present invention, the at least two accommodation apertures in each case comprise at least one wall inclined inwards, in order for solid portions contained therein to be propelled centrifugally outwards through the application aperture by the rotation of the metering housing. The axis of the respective accommodation apertures can therefore be inclined against the vertical, and specifically downwards and outwards. This further embodiment has also proved to be advantageous, because the output of the at least one solid portion through the application aperture is not always guaranteed with a rapid rotation in the output direction of rotation, if this shaping of the accommodation apertures is not realised. By the inclining of the respective at least one outwards facing inner wall of the accommodation apertures in the radial direction, the at least one solid portion contained in the accommodation apertures is propelled outwards during the rotation by the centrifugal force, and passes more easily over the inclined surface, via the application aperture, out of the dispensing device.

In a further preferred second design variant of the invention, the positioning device is formed by a trough at or in the inner side of a basic body of the dispensing device, and by an outer side, closing the trough, of a feed dome accommodated by the basic body and rotatable inside it, wherein the feed dome is a part of the retaining device. The retaining device additionally comprises a metering shell, which contains the accommodation apertures for the solid portions. The feed dome is preferably located on the metering shell, and is arranged coaxially to this. The at least two accommodation apertures in the metering shell can also be arranged in a row along an orbit running coaxially to the axis of rotation. The at least two accommodation apertures, depending on the position of the retaining device in relation to a support panel, can be closed downwards by means of the support panel, or be open downwards through an application opening in the support panel. The support panel forms the output element of the dispensing device. By the rotation of the metering shell of the retaining device with its accommodation apertures in the filling direction of rotation, the accommodation apertures are brought one after another into congruency with the positioning shaft, such that solid portions which are present in the shaft fall one after another into the accommodation apertures and are securely held in them. By the subsequent rotation of the metering shell in the opposite direction of rotation (output direction of rotation), the filled accommodation apertures pass one after another over the application apertures, such that the solid portions contained in them fall out. By suitable rotation about a fixed angle range, only a predetermined number of solid portions are transferred into the corresponding accommodation apertures, such that also only these portions are dispensed. Further accommodation apertures remain unfilled.

The retaining device can, in particular, be put under preliminary tension by means of a helical spring, wherein the spring can be supported in the support panel. The preliminary tension of the helical spring produced during the rotation in the filling direction of rotation leads to an automatic rotation of the retaining device in the back direction (output direction of rotation). In order to compensate for this rotation, a rotation damper is further provided, which, like the helical spring, can be supported with its fixed part on the support panel and its rotating part can be connected to the retaining device. The retaining device can preferably be blocked in relation to the support panel by means of a tooth arrangement (ratchet) against a rotational movement in the output direction of rotation. This blocking can be suspended by means of an operational element.

In a preferred further embodiment of this second design variant of the present invention, the dispensing device further comprises a tensioning element for rotating the retaining device between a rotational position, in which the retaining device is under preliminary tension, and a rotational position in which the retaining device is relaxed. Further, the rotation of the tensioning element can be limited by a pre-adjusted stop, such that a filling of the accommodation apertures of the metering shell with the solid portions is limited to a predetermined number. The tensioning element therefore forms, together with the retaining device, a rotatable component part in the dispensing device. The tensioning device can be operated from outside, such that the retaining device can be rotated by the tensioning element, even if the retaining device itself cannot be manually activated from the outside.

The dispensing device according to the invention is preferably essentially rotationally symmetrical with an essentially cylindrical body. The further component parts, apart from the possibly funnel-shaped formation of the feed space and of operating elements, are likewise designed as rotationally symmetrical. As a result, the structural components of the dispensing device are formed in a suitable manner for a rotational movement of the retaining device.

The components of the dispensing device according to the invention, with the possible exception of the elastic element, are preferably made of plastic, for example by injection moulding or an extrusion process.

BRIEF DESCRIPTION OF THE DRAWING FIGURES

Figure 1B:
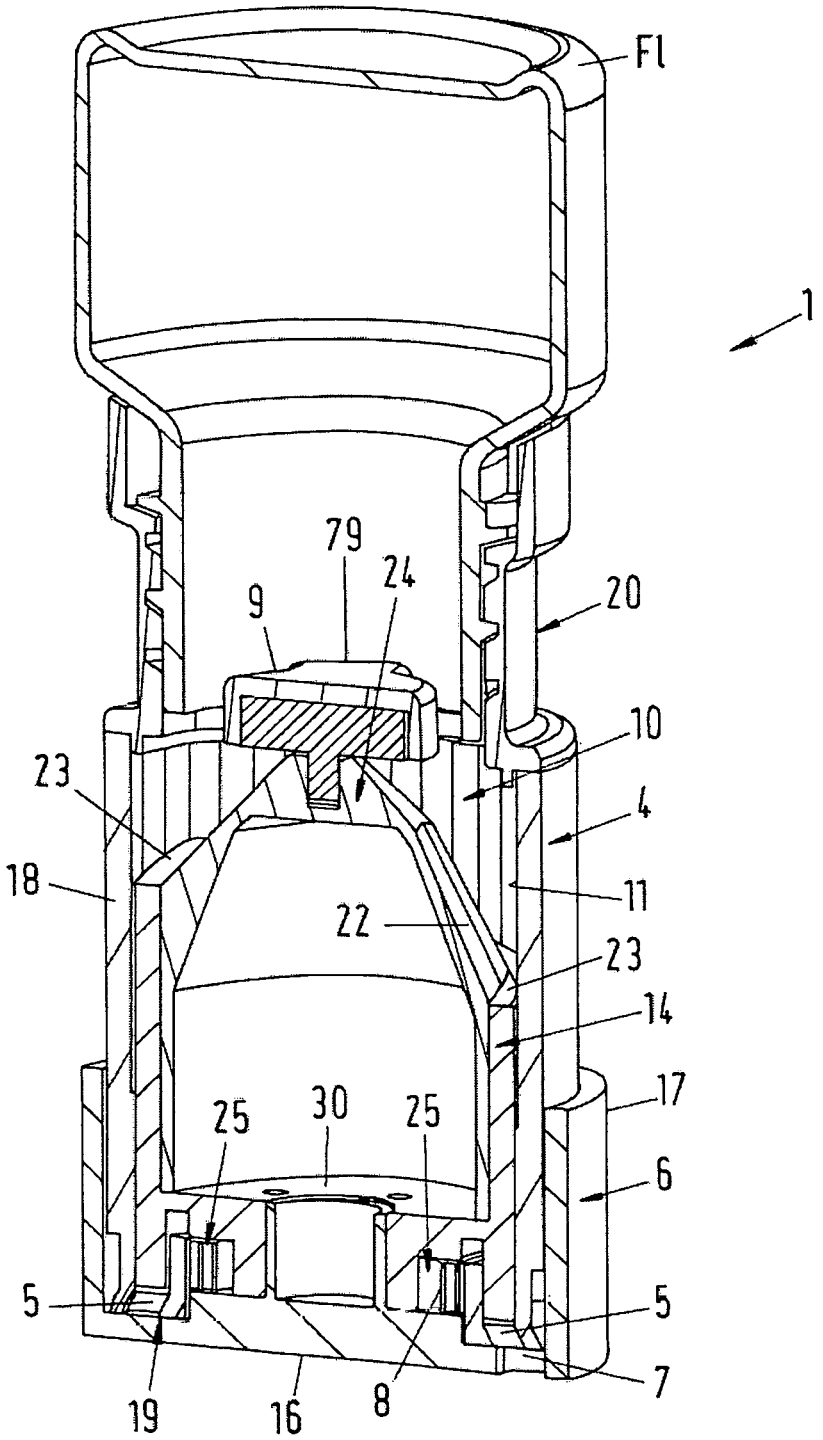
Figure 2:
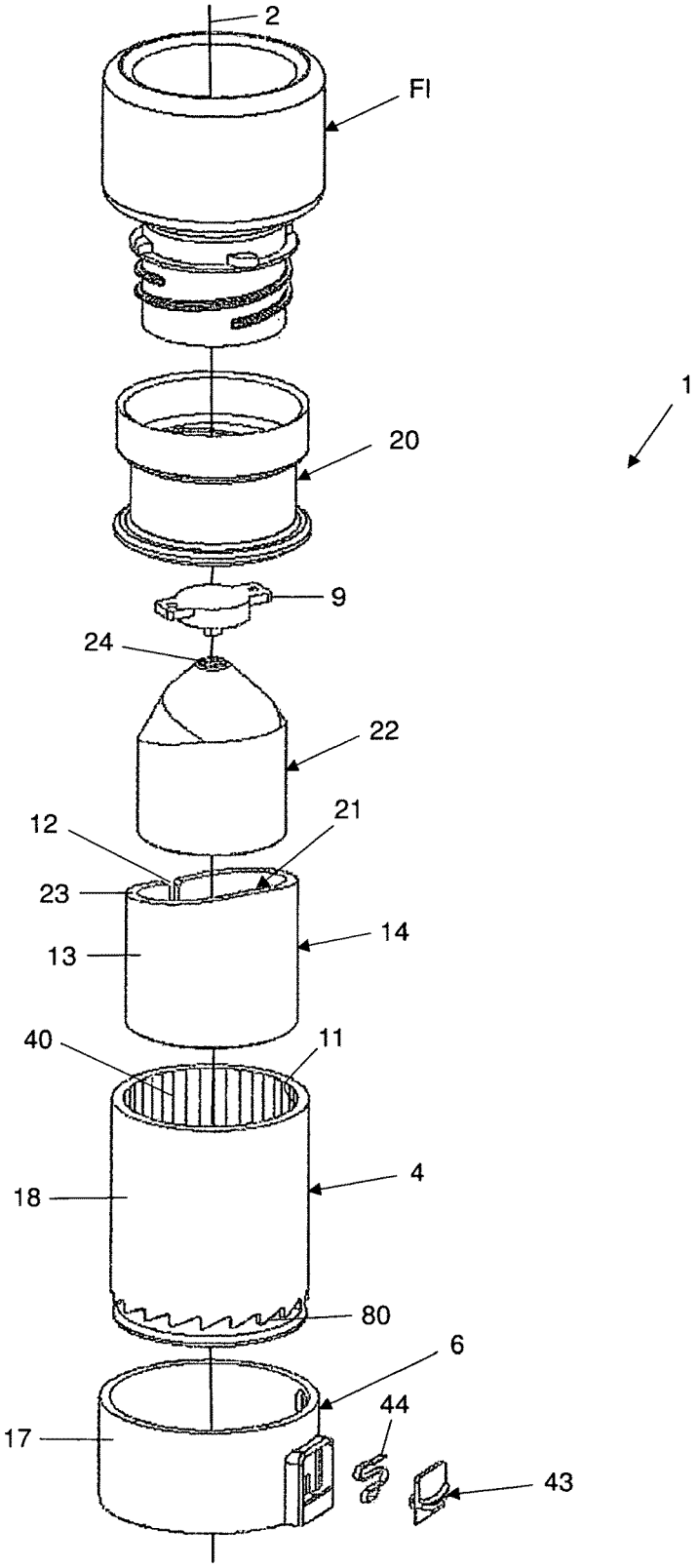
Figure 3A:
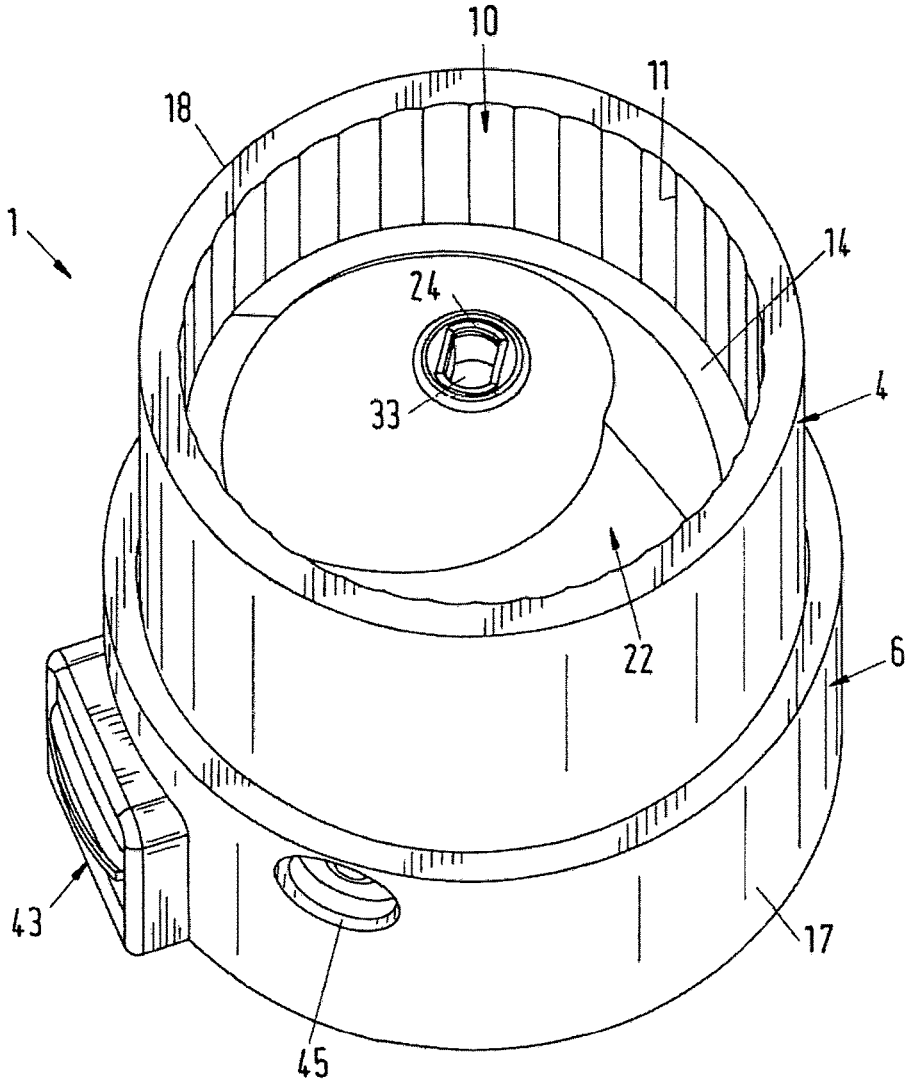
Figure 4:
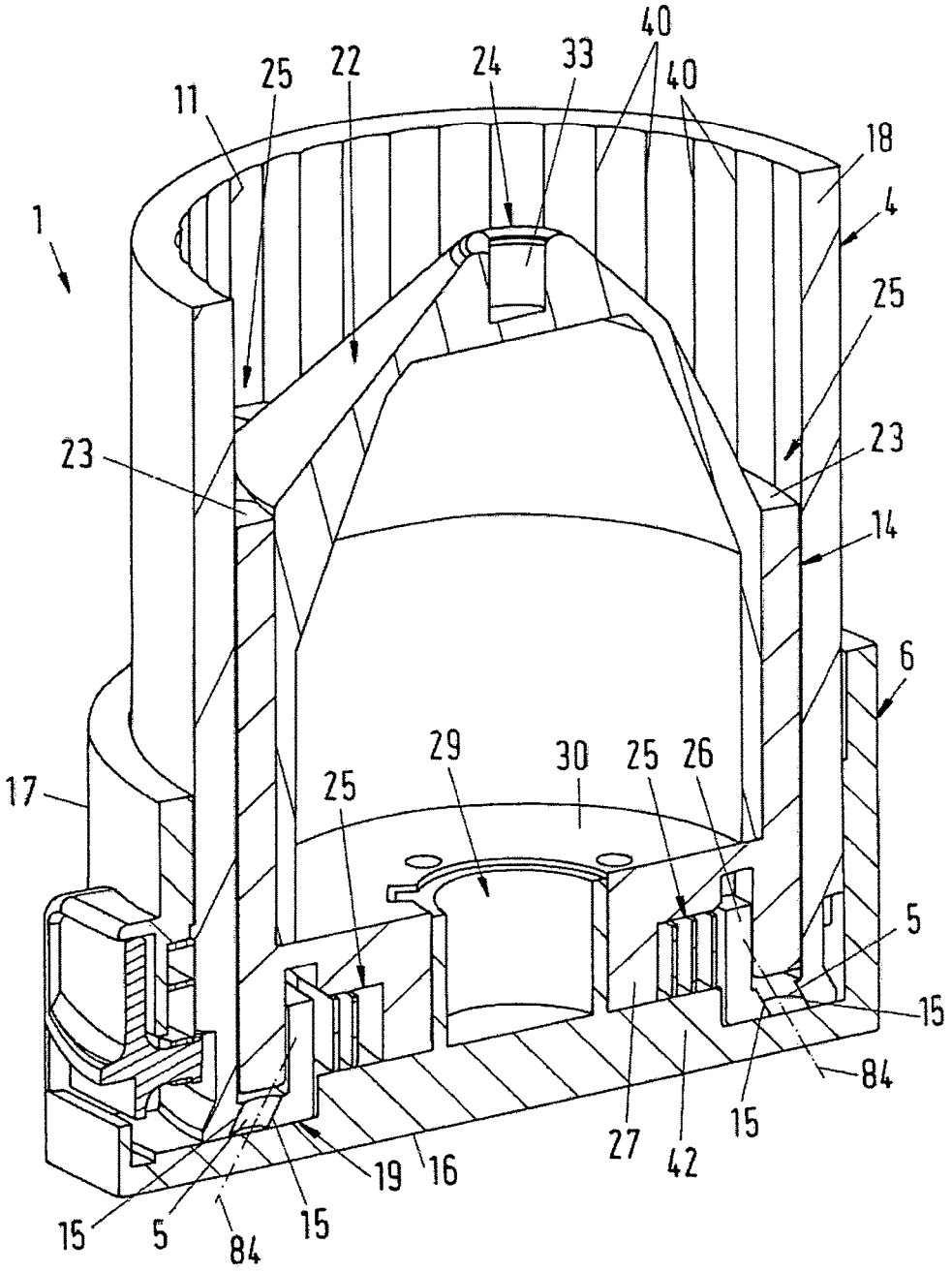
Figure 5A:
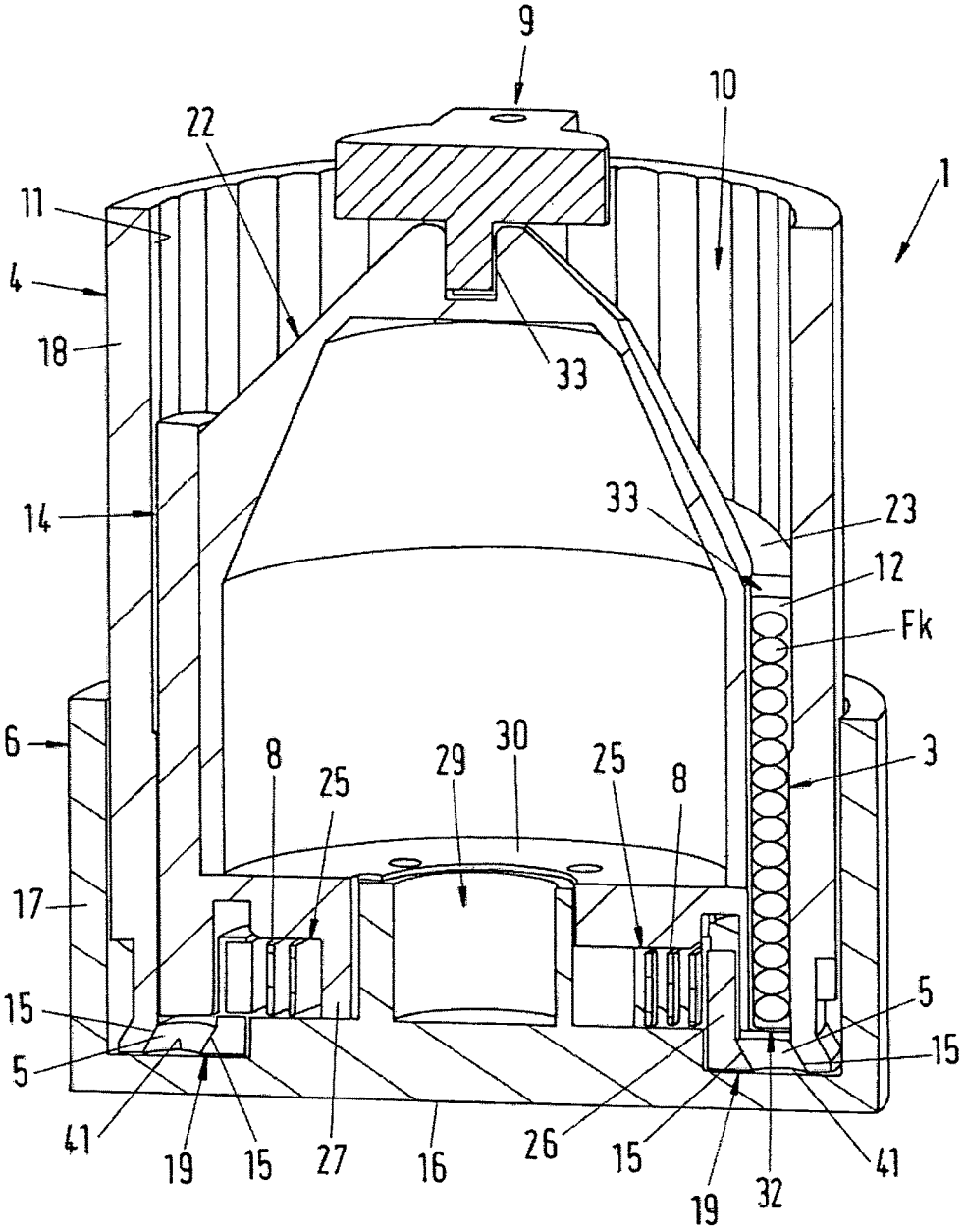
Figure 6:
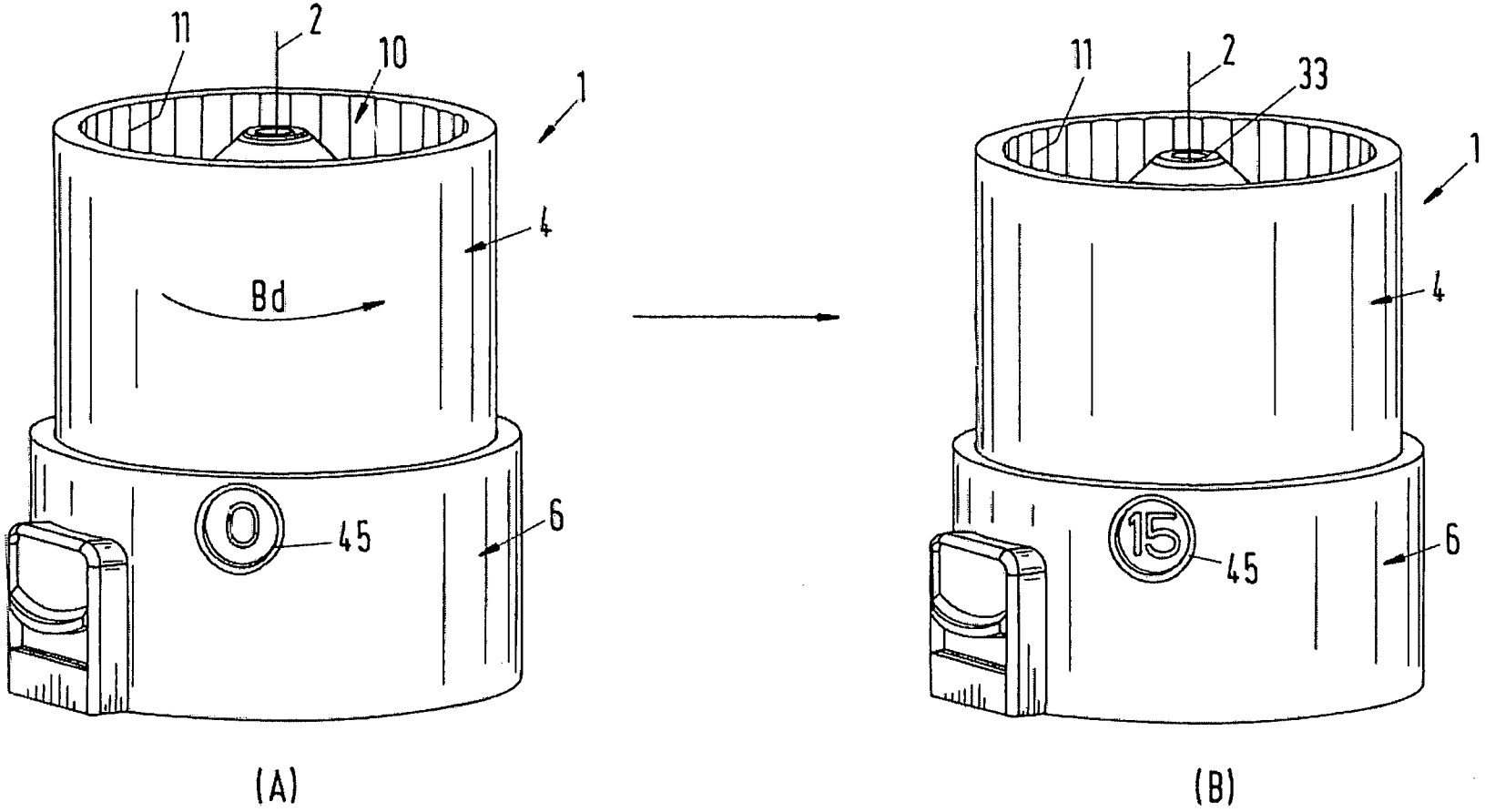
Figure 7A:
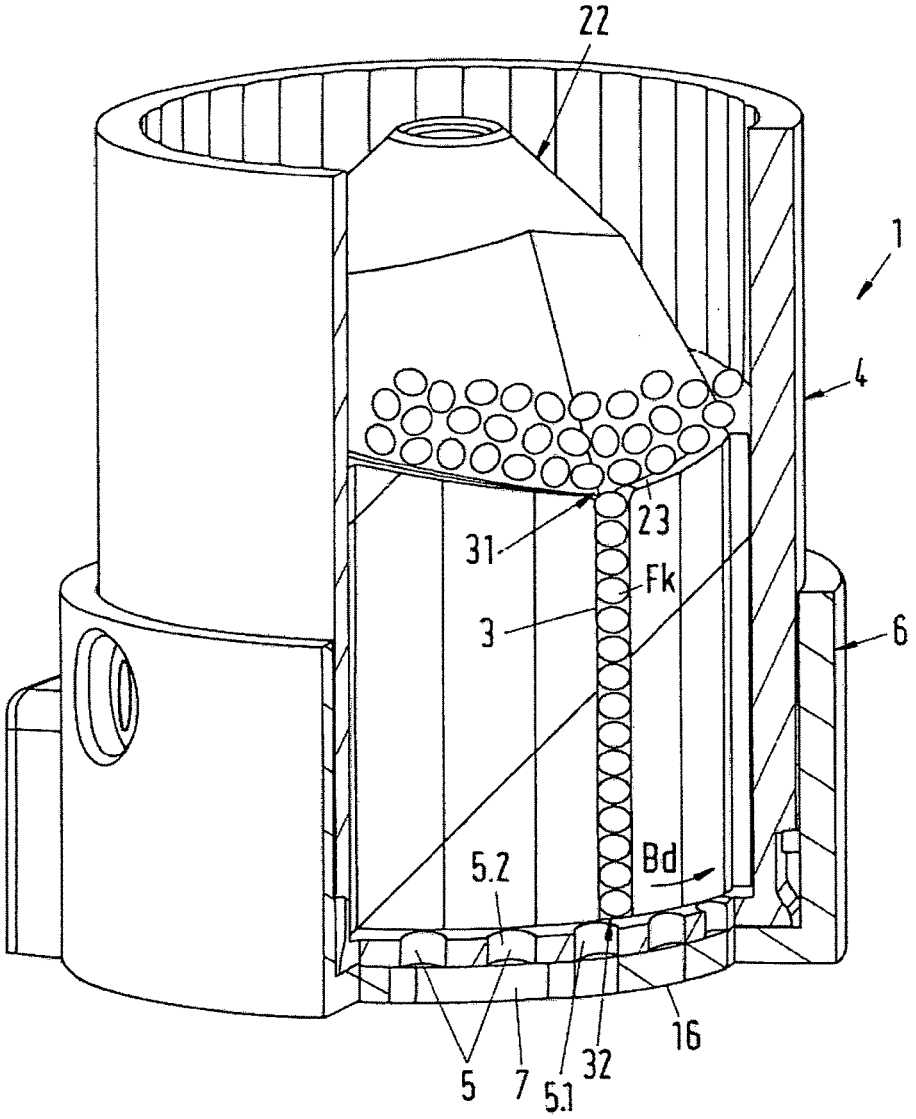
Figure 7B:
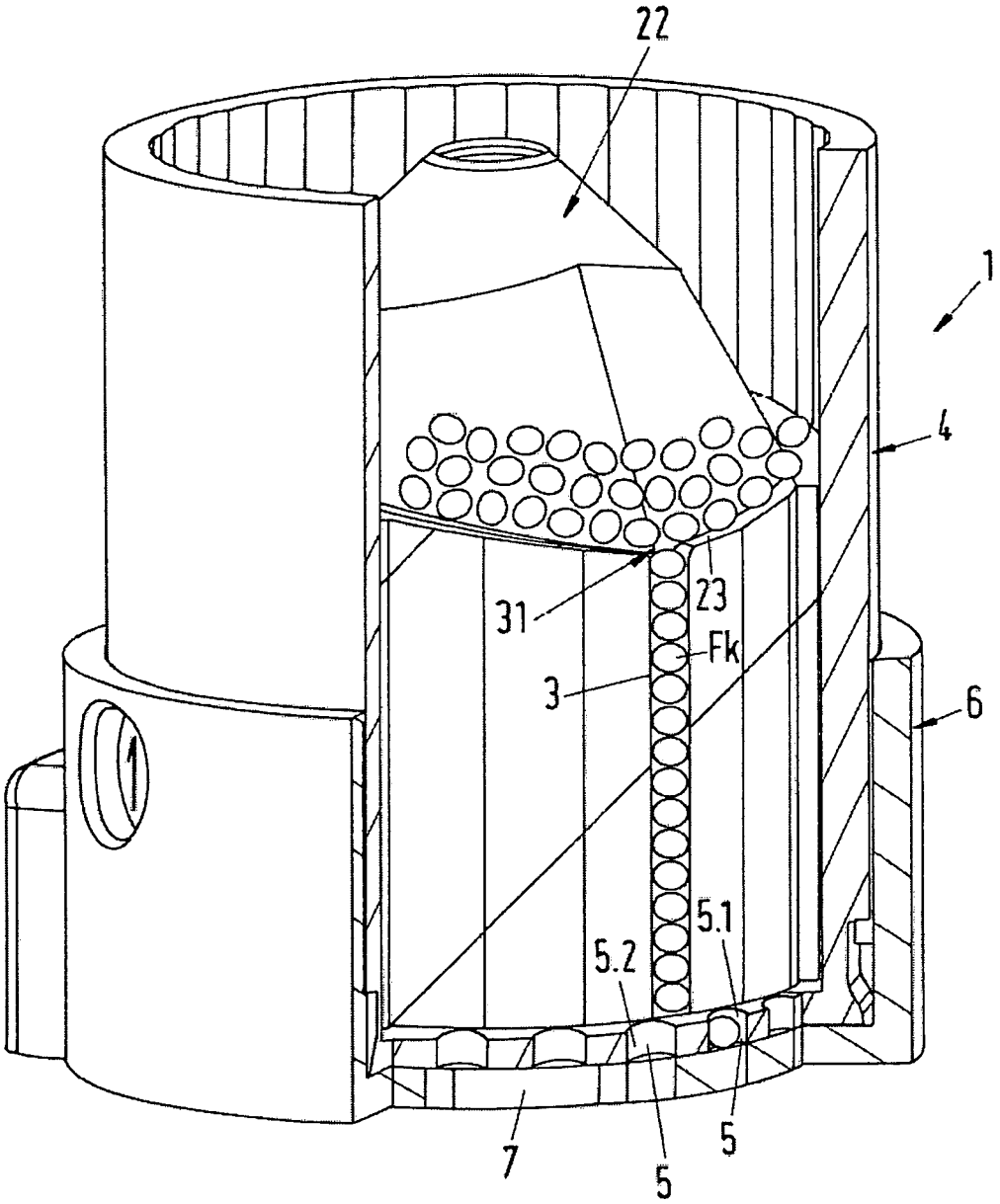
Figure 7C:
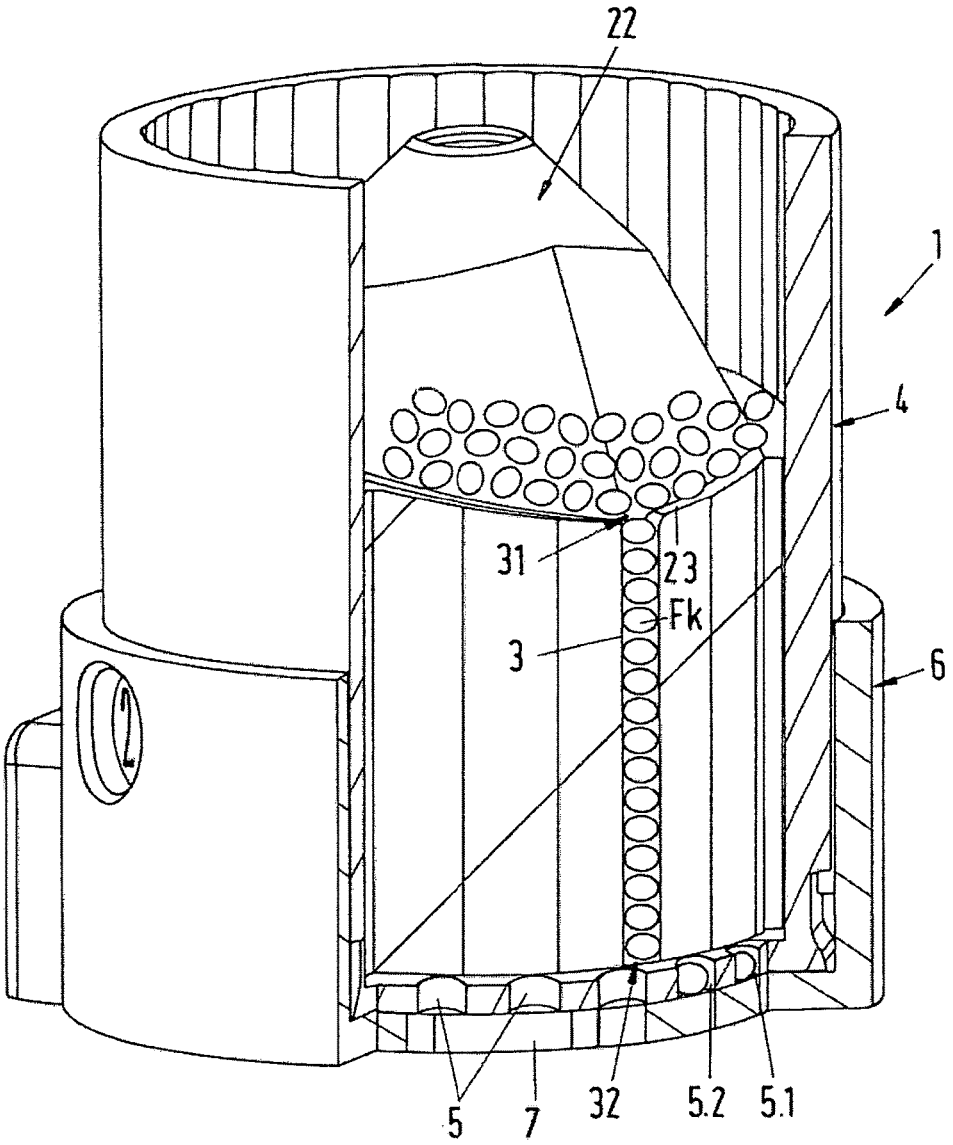
Figure 8:
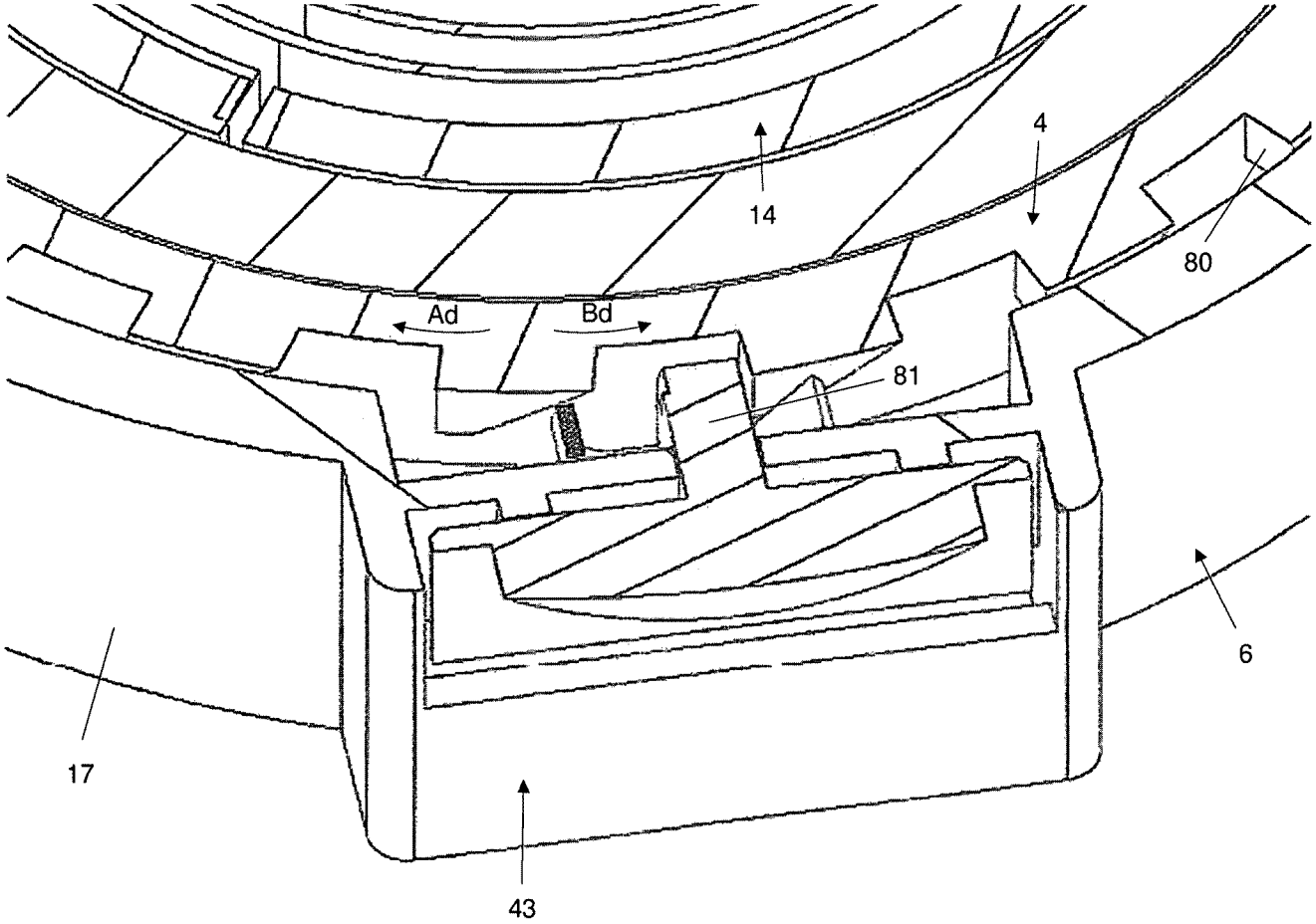
Figure 9:
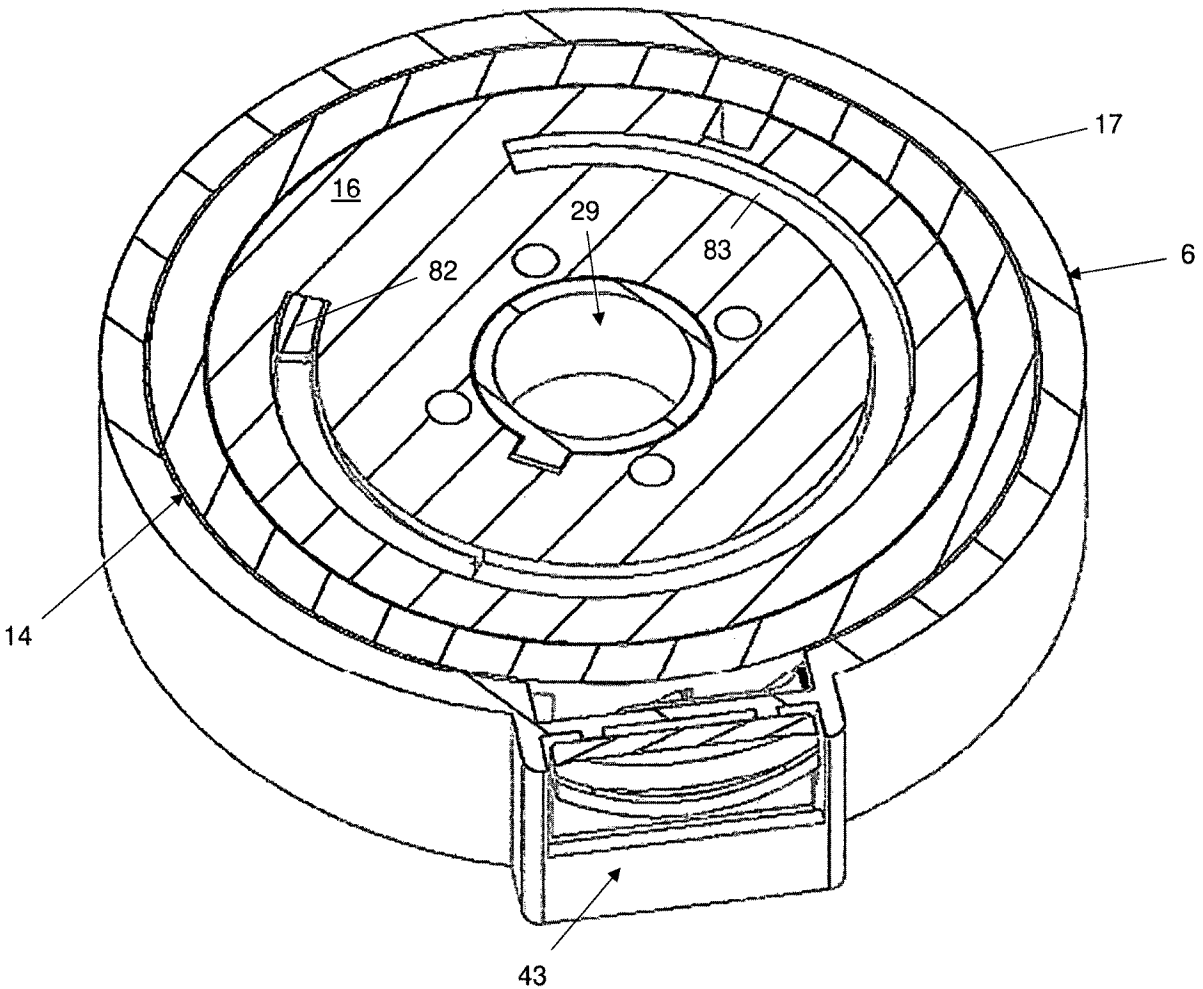
Figure 10:
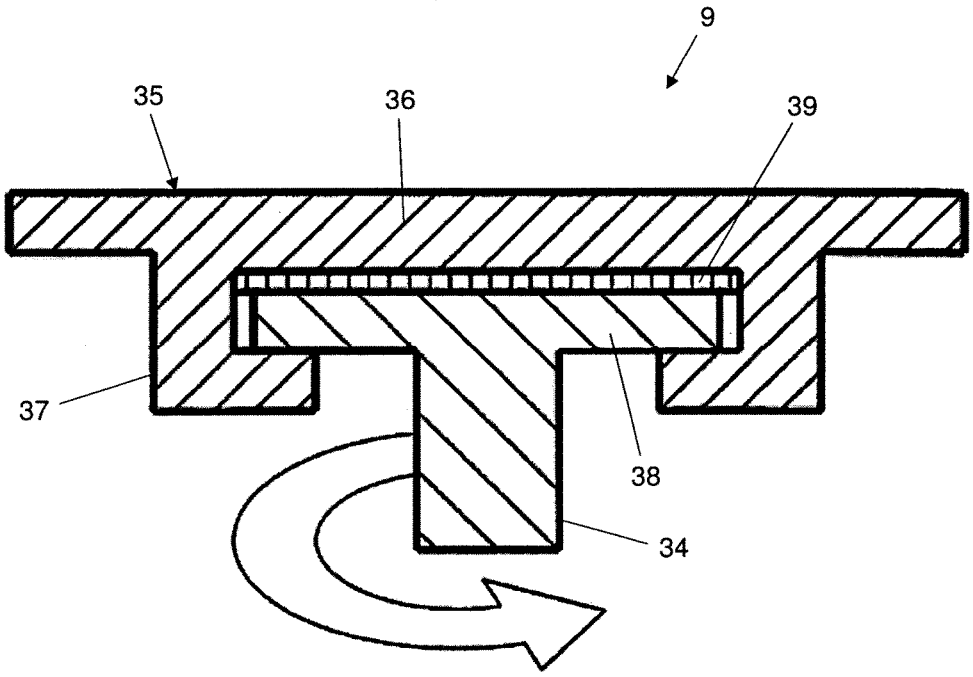
Figure 11:
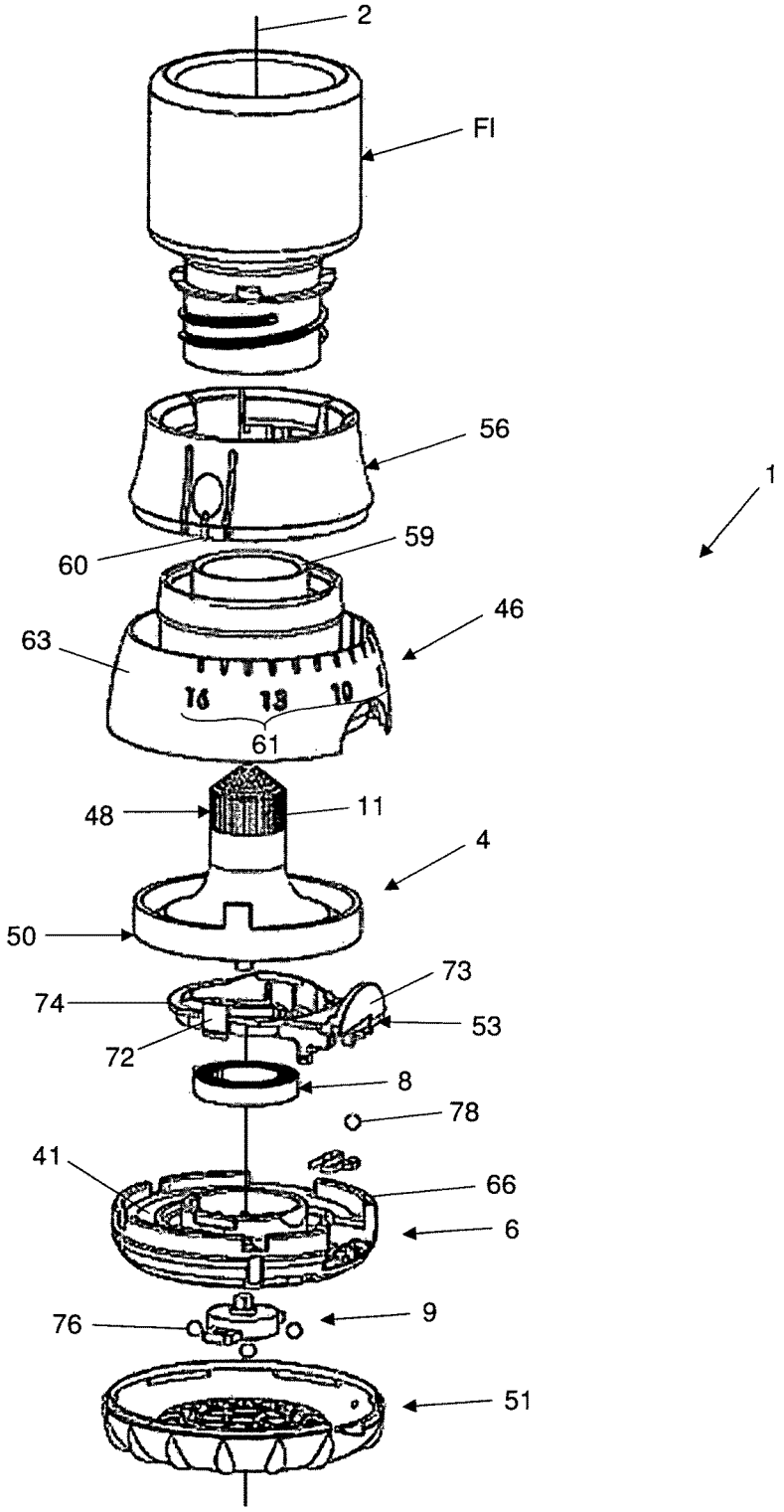
Figure 12:
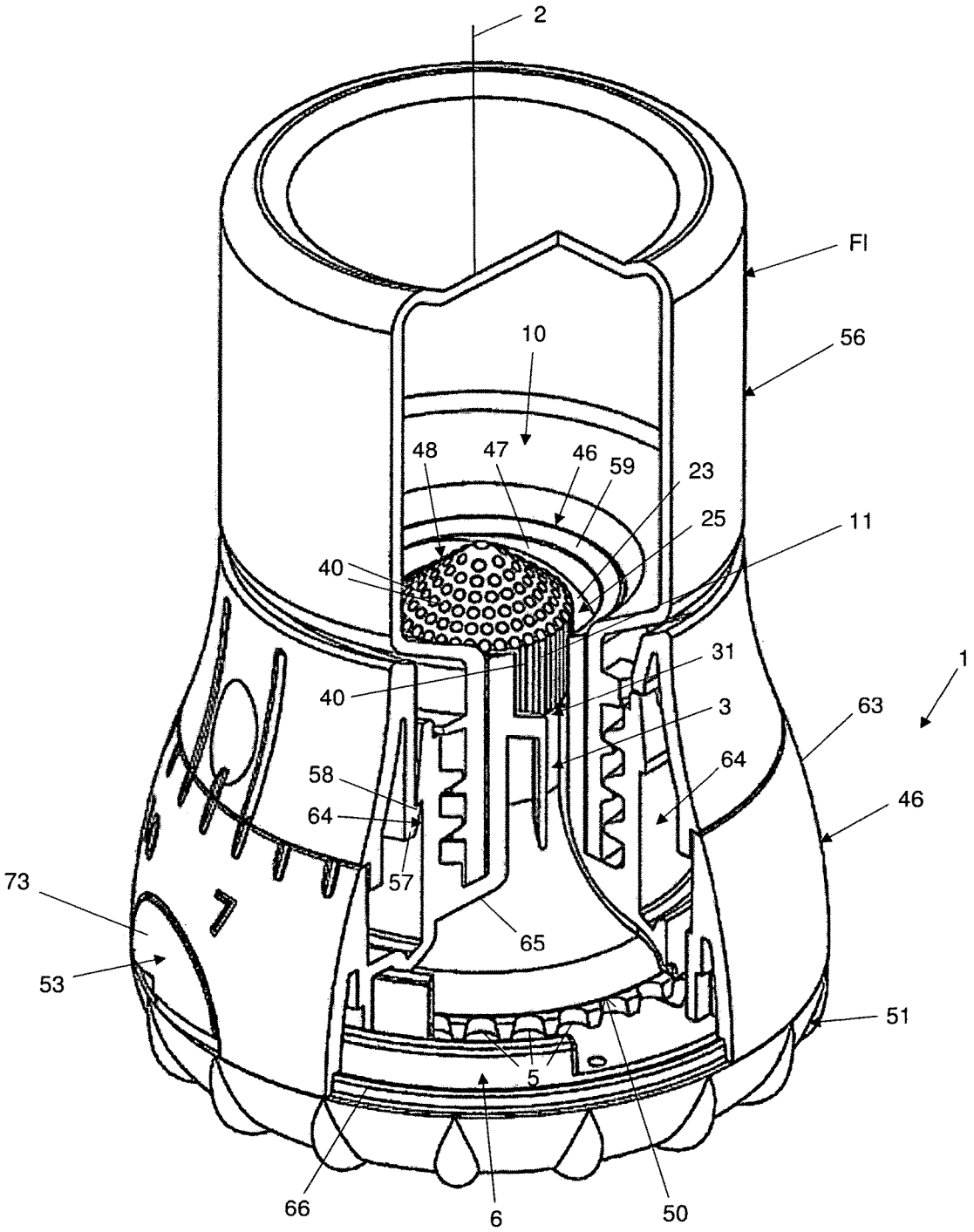
Figure 13:
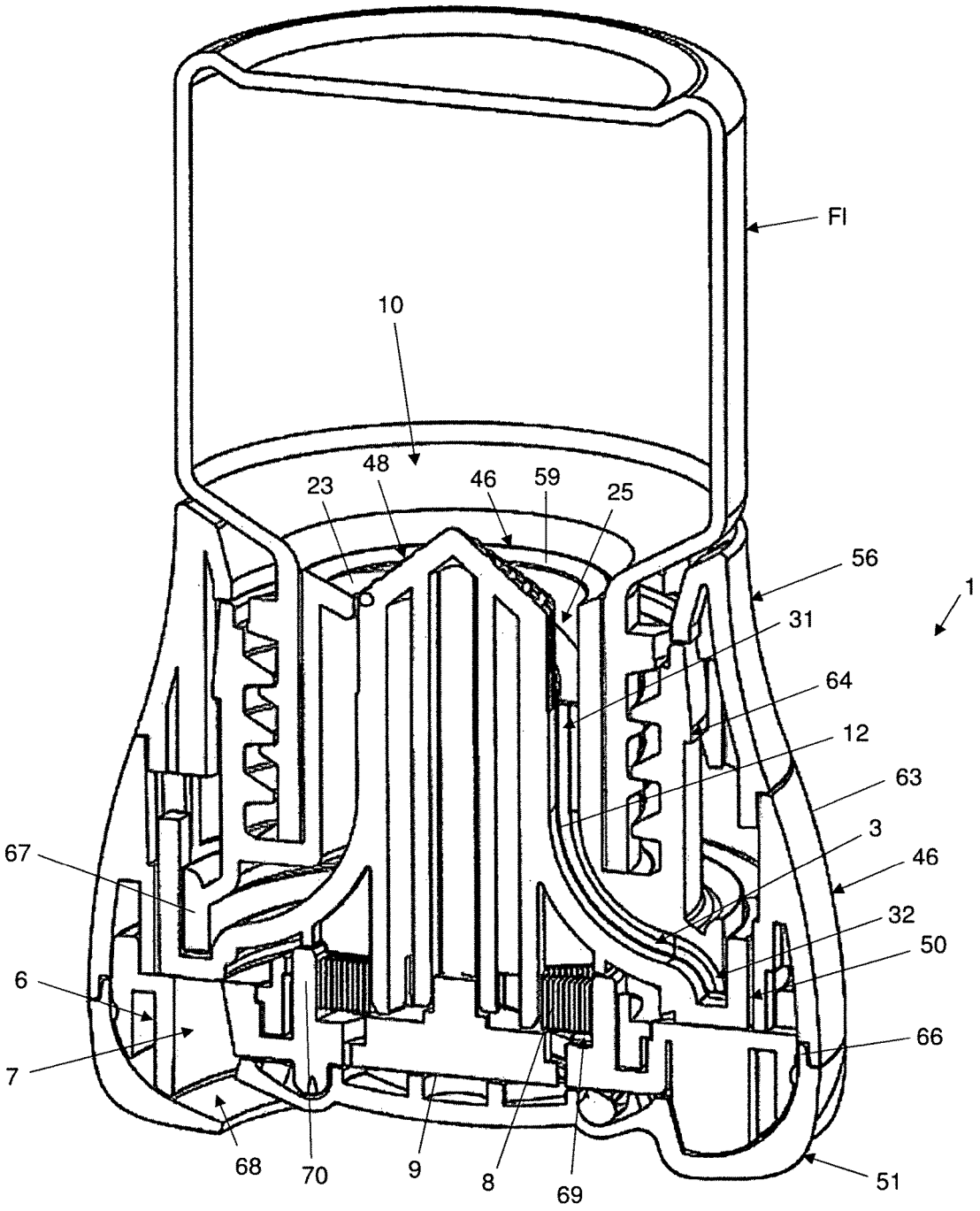
Figure 14:
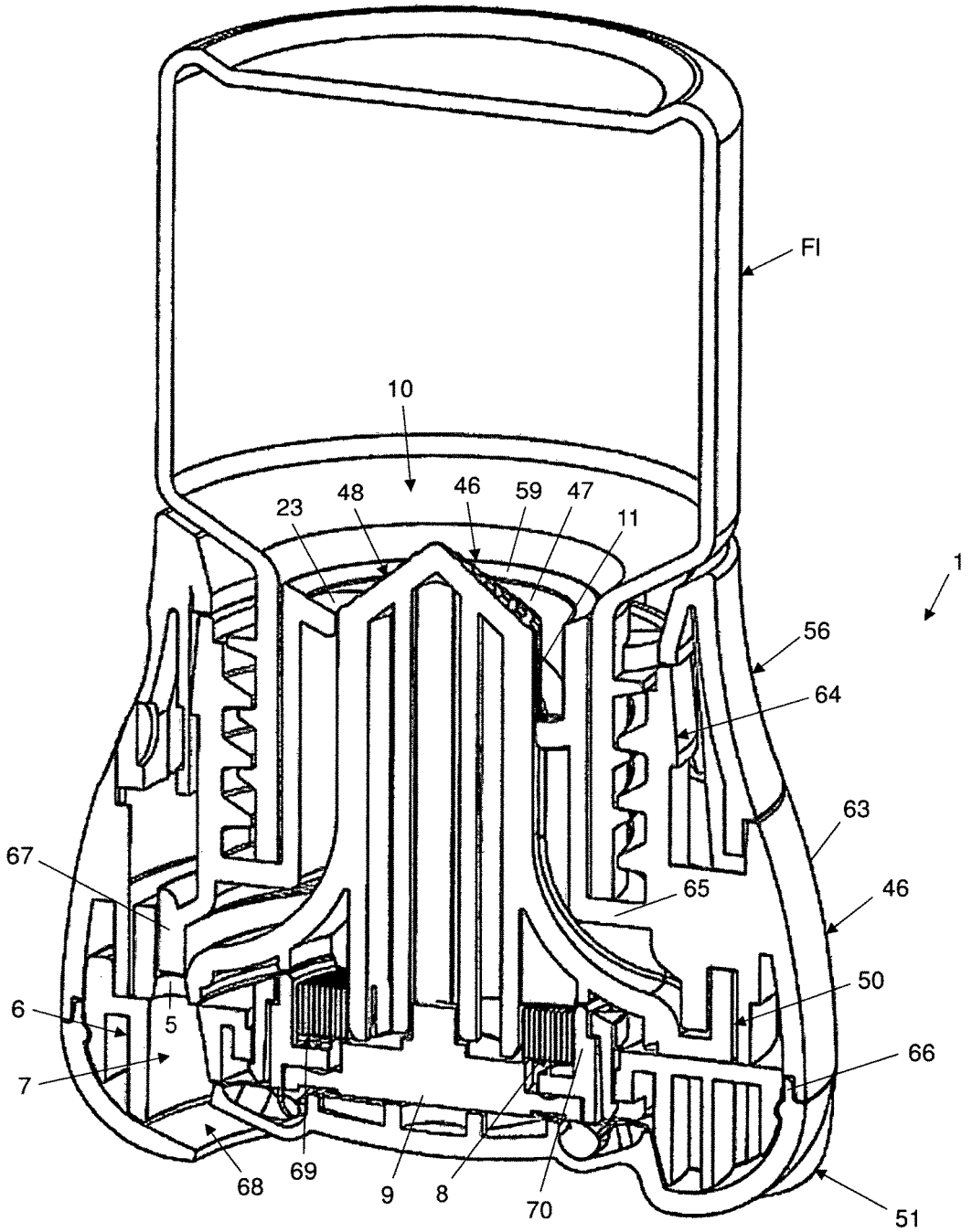
Figure 15:
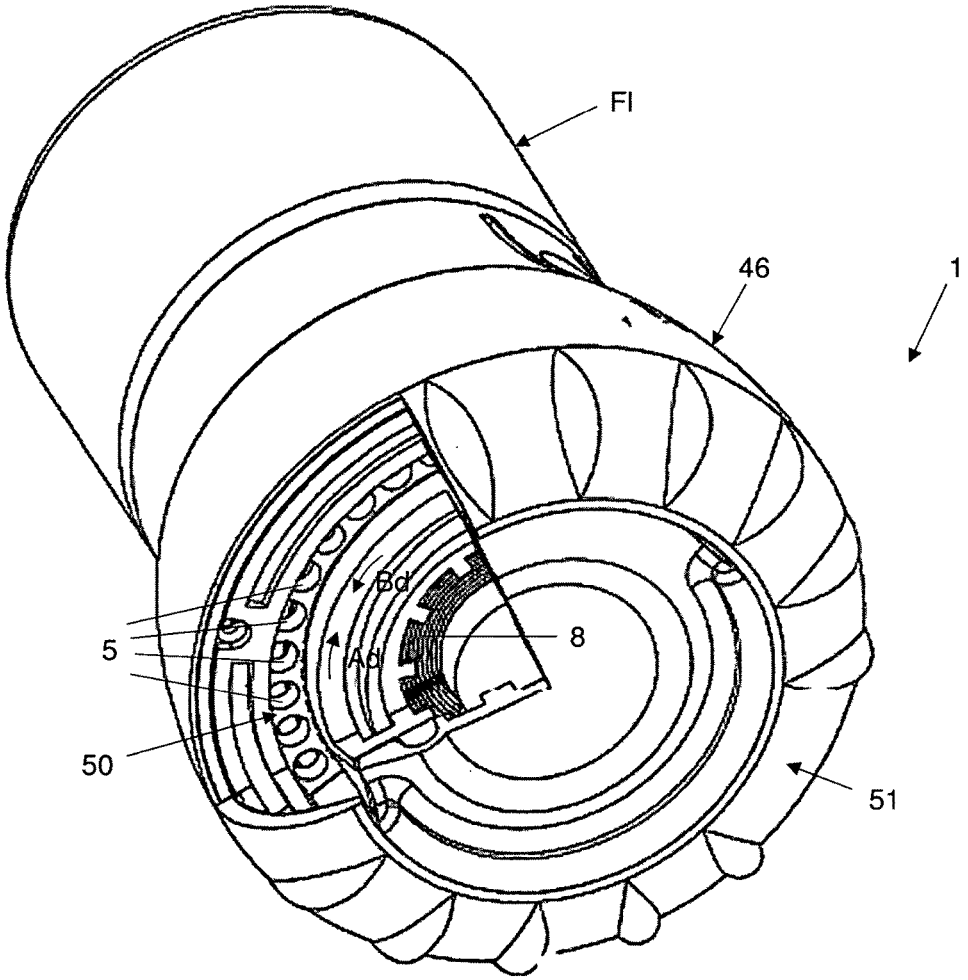
Figure 16:
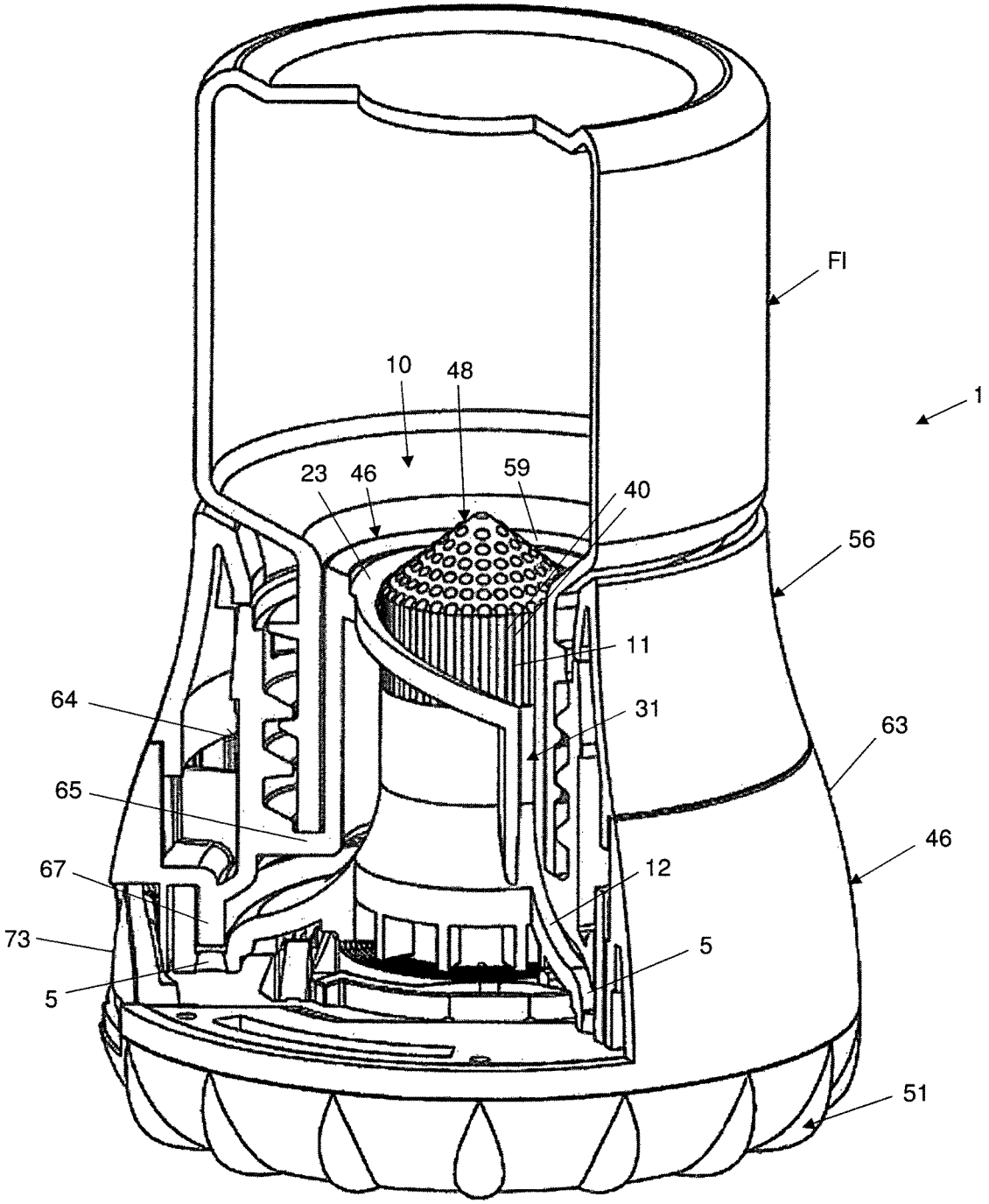
Figure 17:
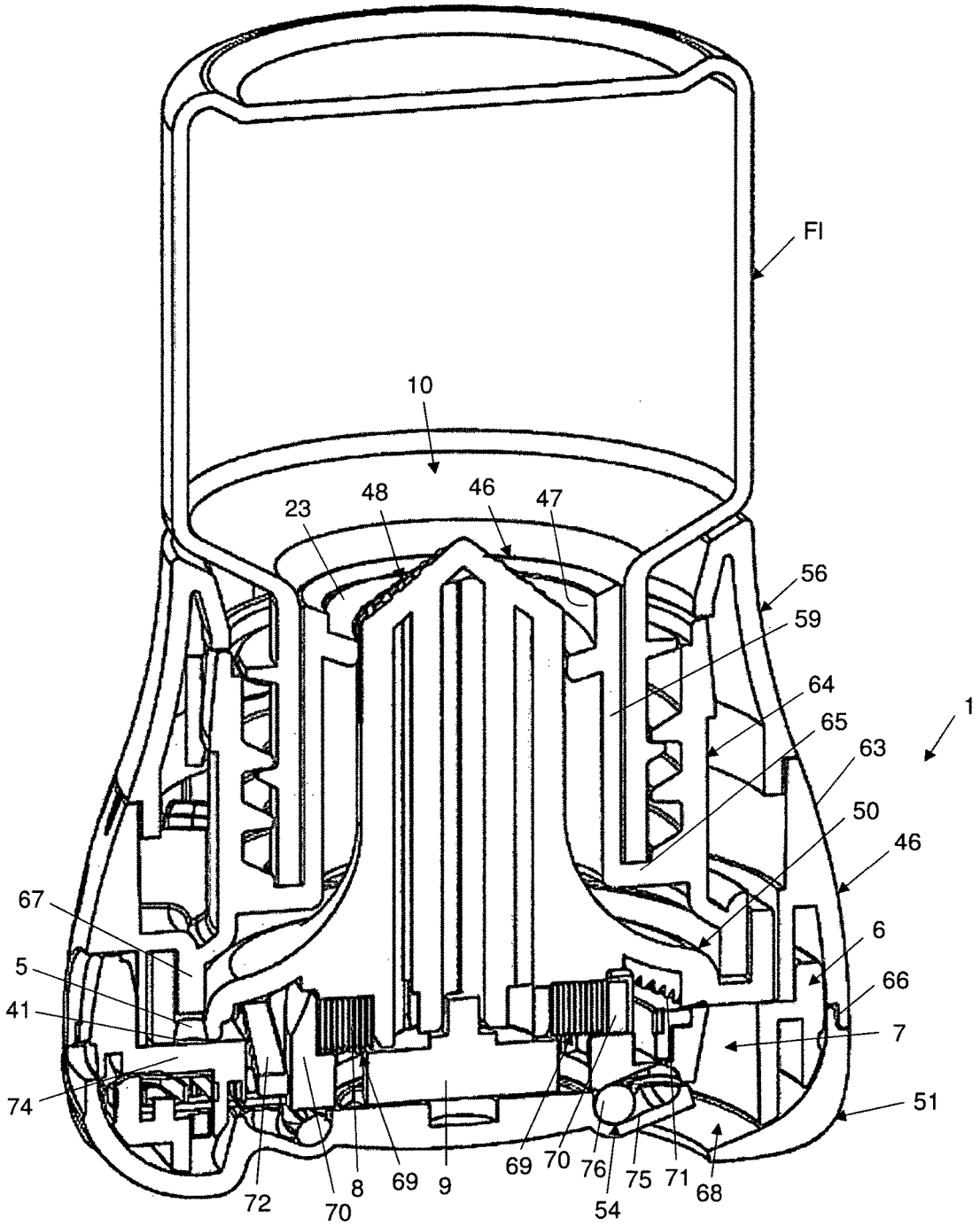
Figure 18:
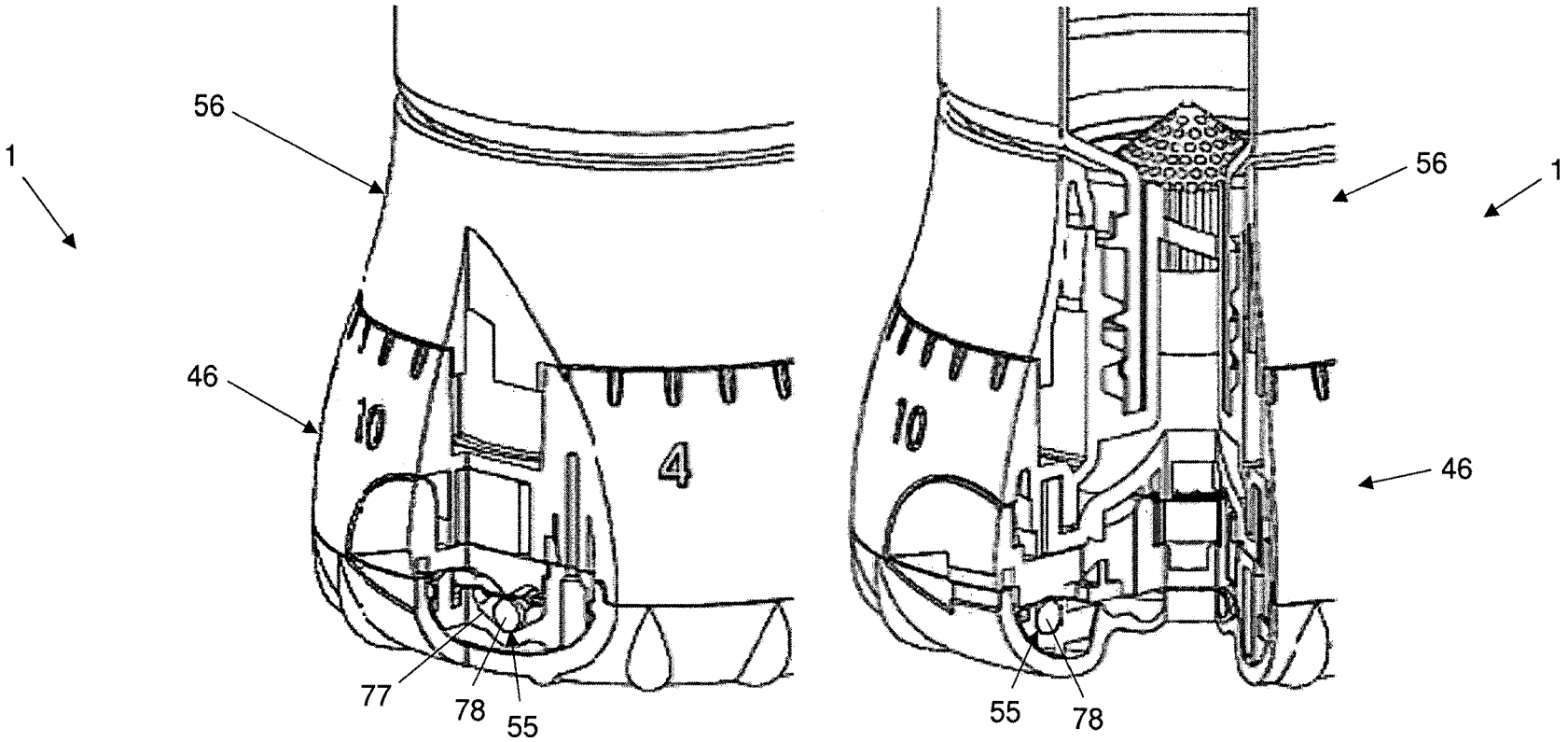
Figure 19A:
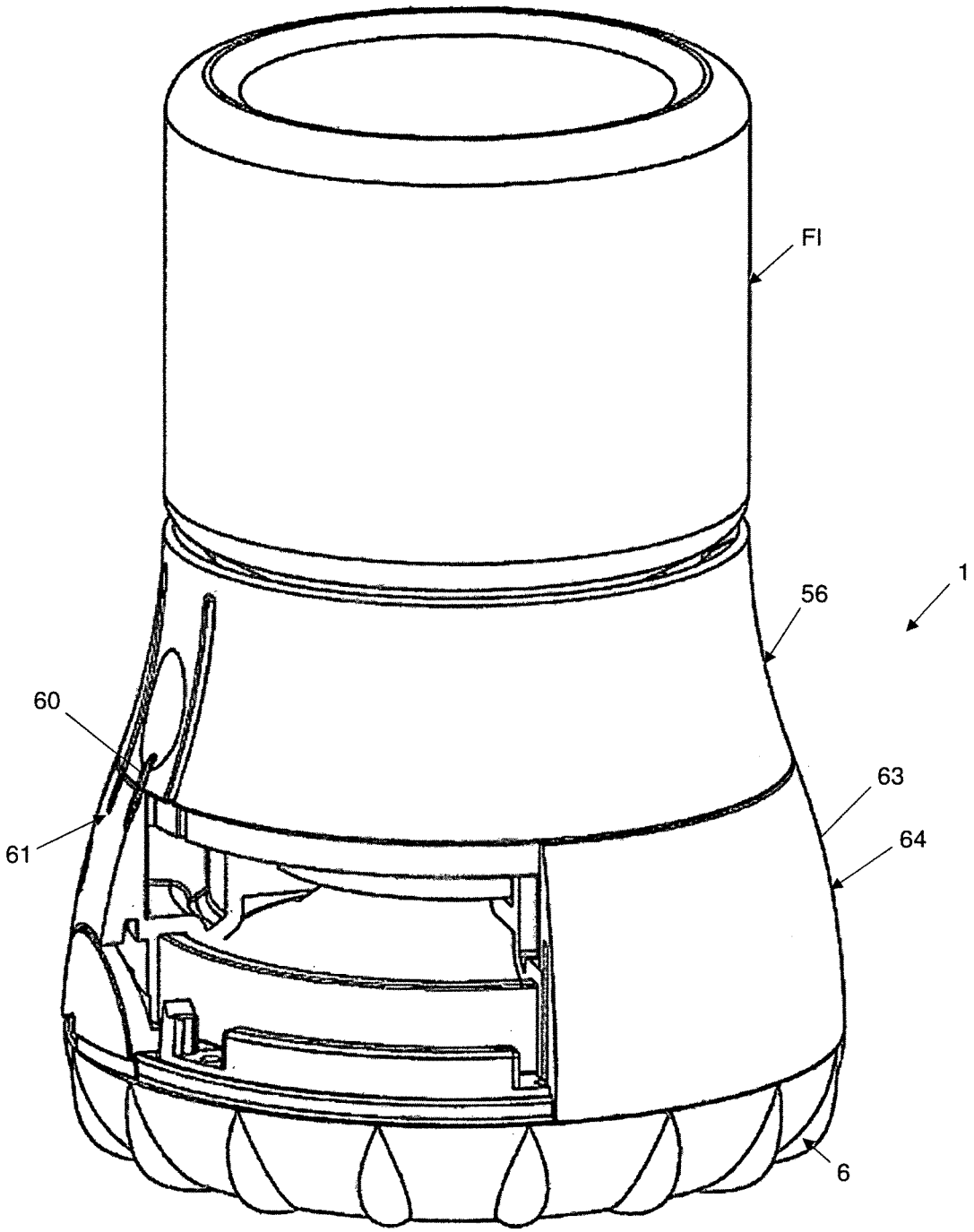
Figure 19B:
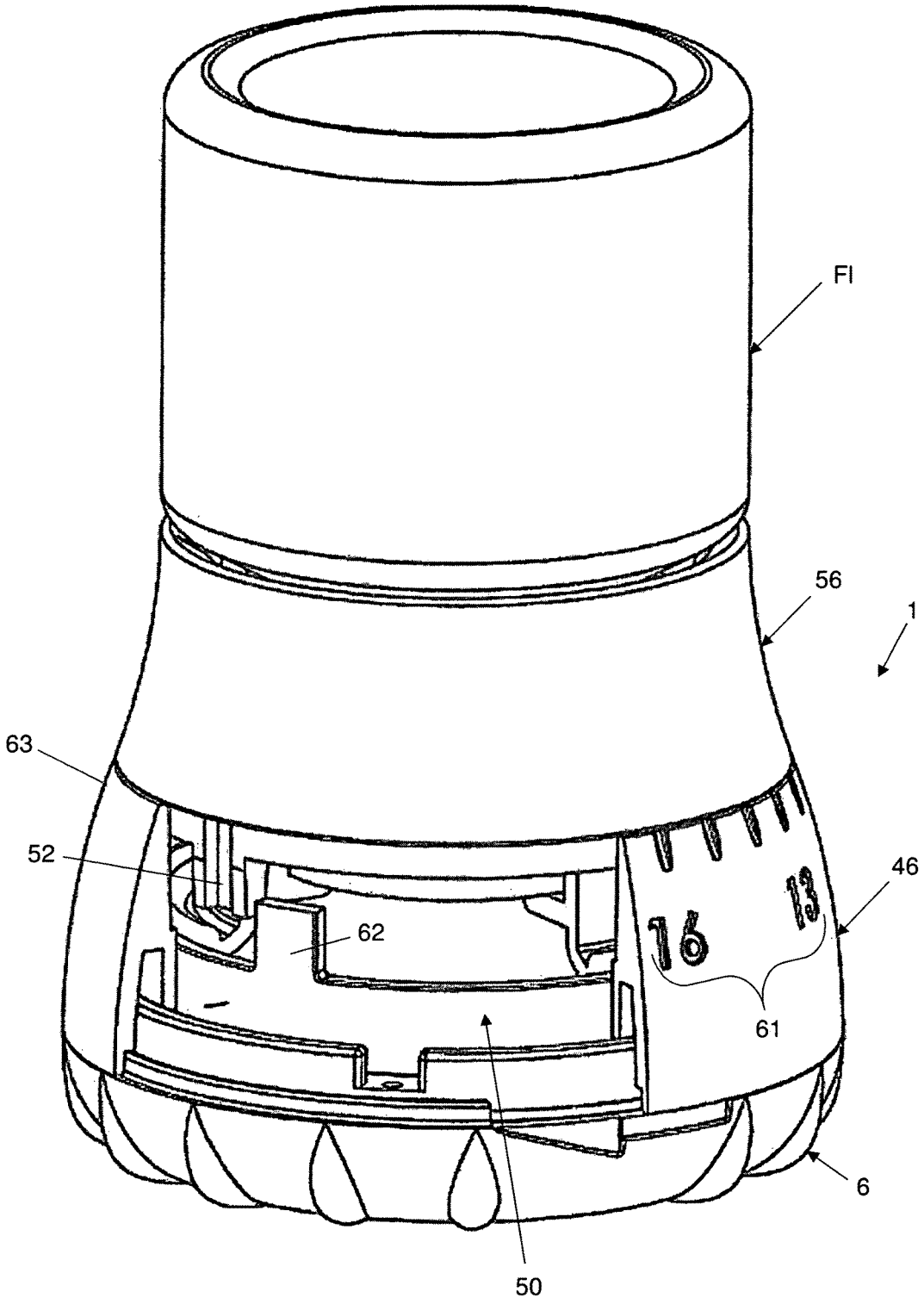
Figure 20:
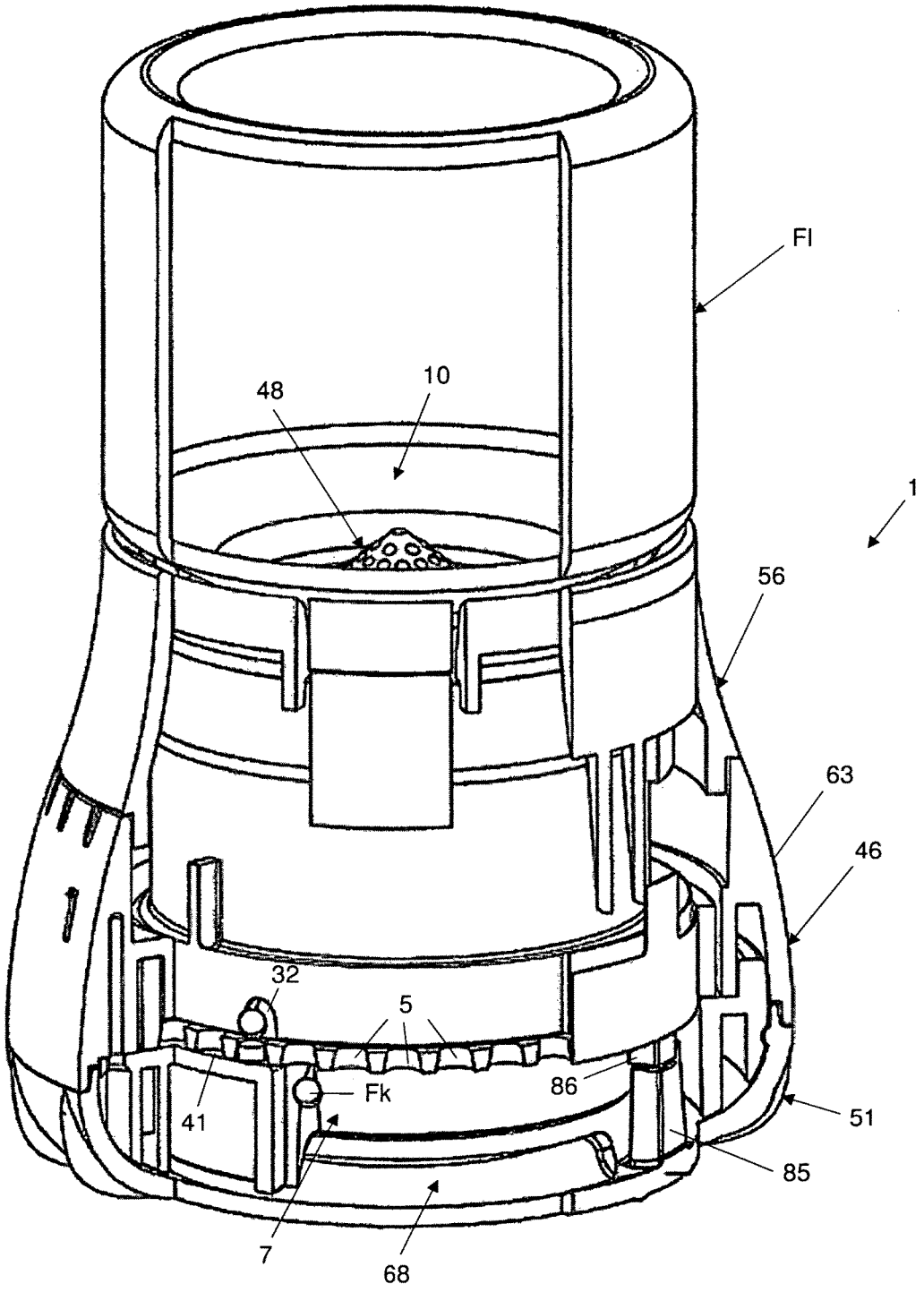
Figure 21:
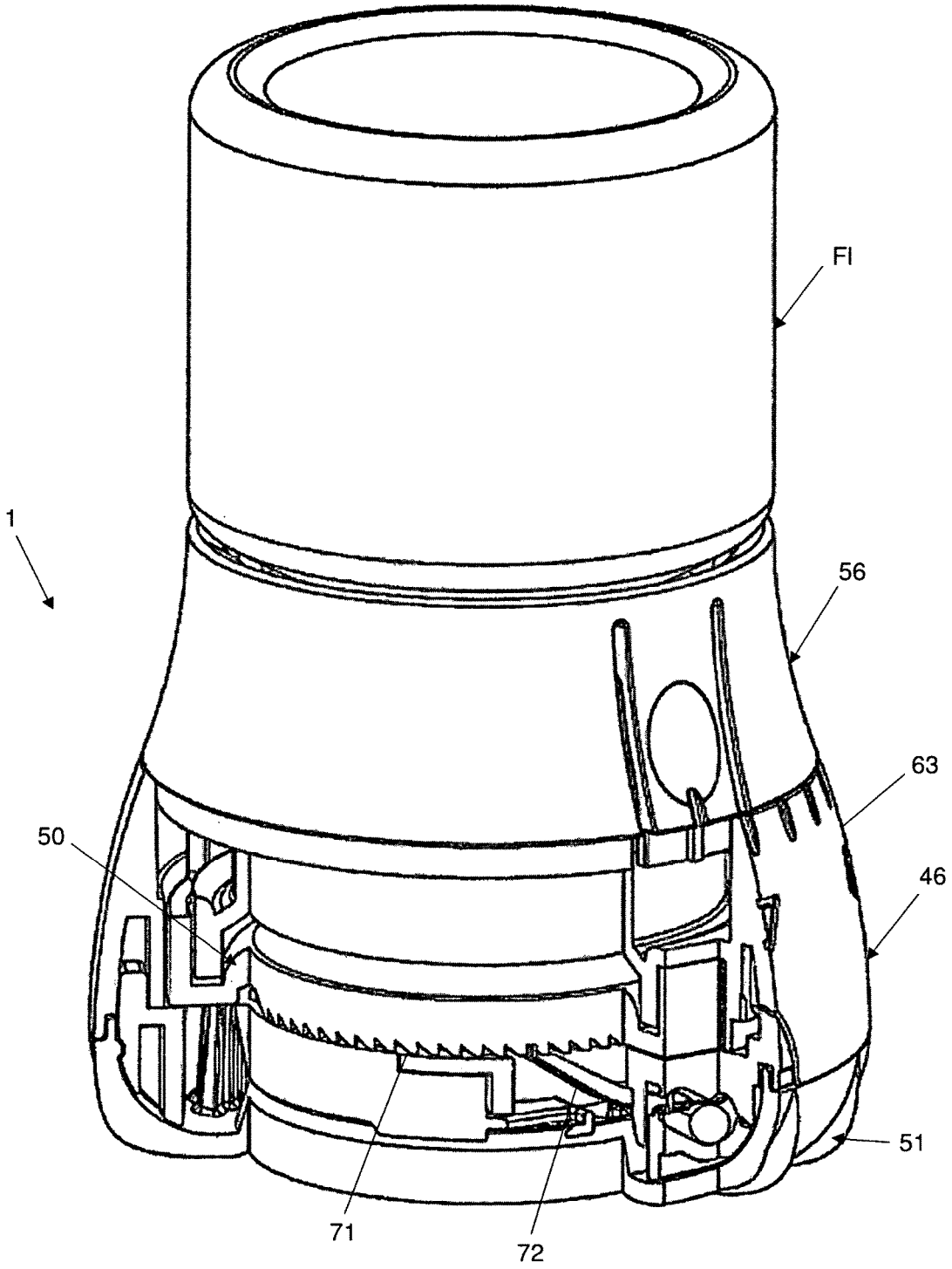
Figure 22:
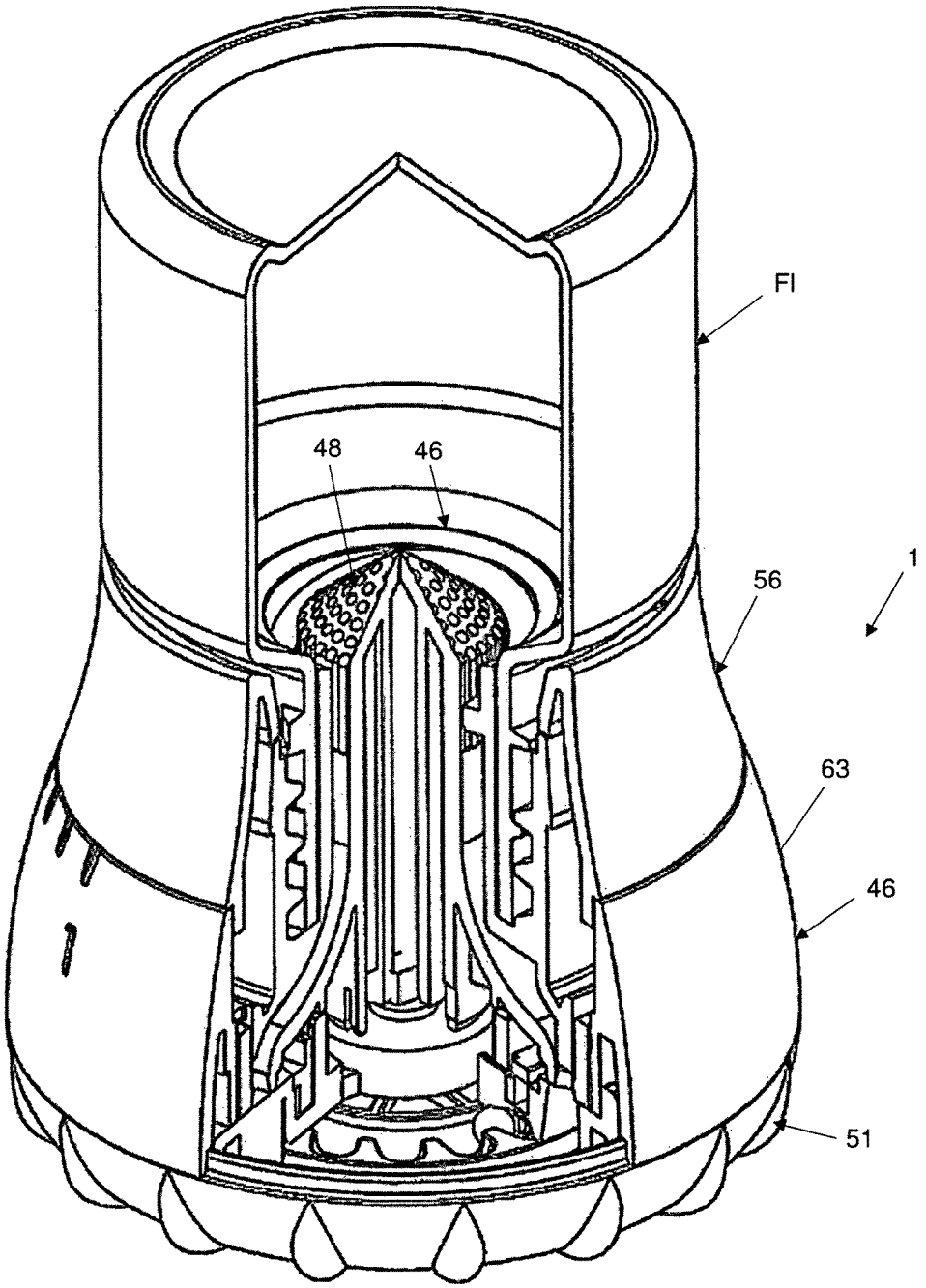

The present invention is explained in greater detail on the basis of the figures described hereinafter. These serve solely as illustration, and are therefore to be understood as solely exemplary. These show, in detail:

FIG. 1: An overall view of the dispensing device according to the invention in a first design variant, with a tablet bottle screwed to it; (A) in a perspective view, and (B) in a perspective sectional view;

FIG. 2: An exploded representation of the dispensing device from FIG. 1;

FIG. 3: A view of the dispensing device according to the invention from FIG. 1 in a view with the feed cone and feed element in the metering housing; (A) in a perspective view from above, and (B) in a sectional view from the side with a bottle screwed on;

FIG. 4: A perspective sectional view of the dispensing device from FIG. 1, with inclined accommodation apertures;

FIG. 5: A sectional view of the lower area of the dispensing device from FIG. 1; (A) with a feed of tablets through the positioning shaft and transfer into an accommodation aperture, (B) detail from FIG. 5A with the issuing of a tablet;

FIG. 6: View of the dispensing device from FIG. 1; (A) in the basic setting; and (B) after the transfer of 15 tablets into the accommodation apertures;

FIG. 7: Perspective part sectional view of the lower part of this dispensing device from FIG. 1; (A) filling of the positioning shaft and rotation of the metering housing, (B) transferring of tablets into the accommodation apertures, and (C) output of a tablet after the reversal of the direction of rotation;

FIG. 8: Perspective view of a horizontal section through the dispensing device from FIG. 1, at the height of the tooth arrangement on the metering housing, detailed view;

FIG. 9: Perspective view of a horizontal section through the dispensing device from FIG. 1, through the floor of the application homing;

FIG. 10: Schematic representation of a rotation damper in a sectional view;

FIG. 11: An exploded representation of the dispensing device according to the invention, in a second design variant with a tablet bottle screwed onto it;

FIG. 12: A perspective sectional view of the dispensing device from FIG. 11, with a partial representation of the positioning shaft;

FIG. 13: A perspective sectional view of the dispensing device from FIG. 11, with a representation of the positioning shaft;

FIG. 14: A perspective sectional view of the dispensing device from FIG. 11, with a representation of an accommodation aperture closed from above;

FIG. 15: A perspective sectional view of the dispensing device from FIG. 11, seen from the underside;

FIG. 16: A perspective sectional view of the dispensing device from FIG. 11, with a representation of the positioning shaft and an accommodation aperture closed from above;

FIG. 17: A perspective sectional view of the dispensing device from FIG. 11, with a representation of the filling tilt securing arrangement;

FIG. 18: A perspective sectional view of the dispensing device from FIG. 11, with a representation of the initiating tilt securing arrangement;

FIG. 19: A front view of the dispensing device from FIG. 11, with a partial inner view, with a representation of the stop being subjected to the indexing means by way of the adjustment device;

FIG. 20: A front view of the dispensing device from FIG. 11, with a partial inner view and a representation of tablets emerging from the accommodation apertures;

FIG. 21: A front view of the dispensing device from FIG. 11, with a partial inner view and a representation of a ratchet to block the backwards rotation of the metering shell;

FIG. 22: A front view of the dispensing device from FIG. 11, with a partial inner view.

In the figures described hereinafter, elements which are designated by the same reference numbers are identical elements and/or elements with the same function.

To simplify the figure description, hereinafter, in representation of other solid portions, the term "tablets" is used. Accordingly, when this term is used, this is to be understood to mean in each case any desired type of solid portions.

The dispensing devices according to the invention, shown in the figures, serve to provide the precisely-metered output of solid portions, such as tablets, and, in particular, microtablets.

Shown in FIGS. 1 to 9 is a first design embodiment of a dispensing device 1 according to the invention. In FIG. 1, the dispensing device is connected to a primary packaging means, in the present case a bottle Fl. To do this, the bottle top has been unscrewed, and the dispensing device according to the invention has been screwed onto the neck of the bottle instead of the top. Represented in FIG. 6 is the dispensing device without this bottle.

Figure 3B:
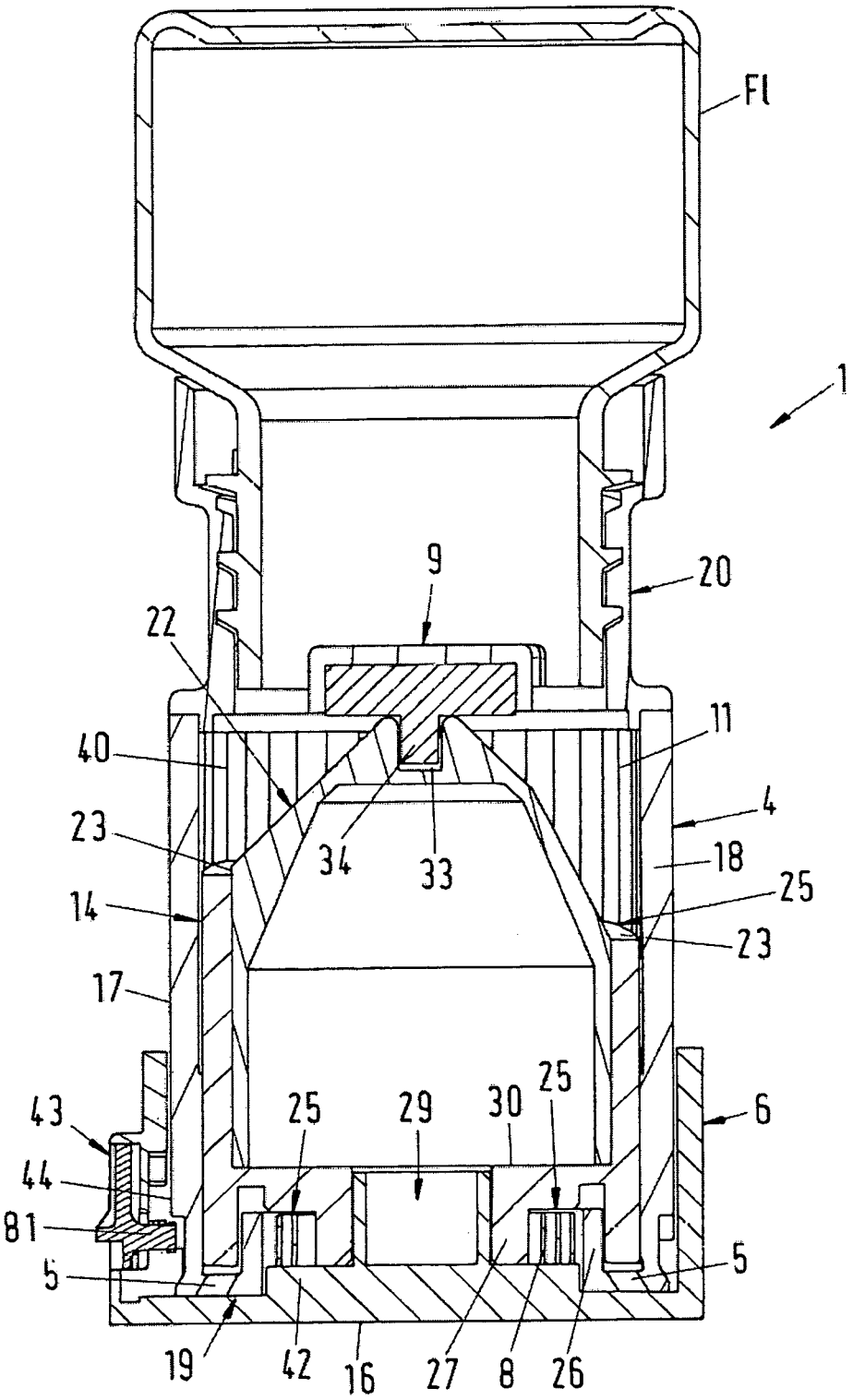

The dispensing device 1 according to the invention has an essentially rotationally symmetrical outer casing with a central axis, which forms an axis of rotation 2 for a retaining device 4. The device 1 comprises an application housing 6 at the base, to which the dispensing device can be held, for example by hand. This housing forms an output device in the meaning of the invention. The application housing comprises a flat base plate 16, with an outside base surface and a cylindrical casing 17. Rotatably mounted in the application housing is a metering housing 4. The metering housing forms the retaining device in the meaning according to the invention. Like the application housing, the metering housing is arranged rotationally symmetrical, and is arranged coaxially in the application housing. The metering housing comprises a cylindrical wall 18, located in the visible area, and at the lower edge an accommodation edge 19, projecting inwards, in which the accommodation apertures 5 are located (FIGS. 3*b*, 4, 5). Secured in the upper area of the metering housing is, further, a connection ring 20 for connecting the dispensing device to the bottle Fl (FIG. 1, 2). This component, too, is essentially rotationally symmetrical, and comprises a cylindrical wall. Located inside the metering housing is a feed element 14, which sits on the base plate 16 of the application housing (FIGS. 1*b*, 4). This component, too, comprises as cylindrical wall, which in the state of use is in contact on the inner side 11 of the metering housing. The feed element further comprises a cylindrical cut-out 21, which is open upwards, into which the feed cone 22 can be introduced (FIG. 2). The feed cone lies with its cylindrical outer side in contact with the inner side of the cut-out in the feed element. The feed cone tapers upwards from the upper edge 23 of the feed element, to a tip 24, which lies on the axis of rotation. Somewhat below the connection ring for the bottle is, further, a rotation damper 9, secured to the inner side of the metering housing (FIG. 1*b*). Its axis of rotation is held torsionally resistant in the tip of the feed cone. Finally, a helical leaf spring 8 is arranged in an annular gap 25 between the feed element and the metering housing (FIG. 3*b*). The feed element, the feed cone, the connection ring, the rotation damper, and the helical leaf spring are in each case arranged coaxially to the central axis of the dispensing device and the axis of rotation of the motoring housing.

The metering housing 4 comprises at its base an accommodation edge 19, projecting inwards, and on an inwards located edge of the accommodation edge a support tab 26, projecting upwards, for the helical leaf spring 8 (FIG. 3*b*). Formed between this support tab and an upwards projecting tubular support column 27 of the feed element 14 is the annular gap 25, which accommodates the helical leaf spring. The feed element sits with the support column on a base element 42 on the base plate 16 of the application housing 6, and is held centrally by means of a central upwards projecting guide column 29 on the base element, which extends into an appropriately shaped cut-out in the base plate 30 of the feed element. The helical leaf spring is in each case connected to the support tab 26 and the support column 27, such that a rotation of the metering housing in relation to the feed element 14, and therefore also in relation to the application housing, leads to the tensioning of the helical leaf spring. Otherwise, the cylindrical wall of the feed element also extends downwards beyond this base plate, and engages into the space between the cylindrical side wall 17 and the support tab 26 of the metering housing, such that the metering housing is guided through a downwards reaching wall of the feed element. The base plate 16 of the application housing comprises in a central area the base element 42, on which the support column 26 of the metering housing is supported. Further located on the base element is the guide column 29, which extends into the cut-out in the base plate 30 of the feed element 14, and therefore likewise holds this. As a result, on rotation, the metering housing is also guided by the application housing.

The cylindrical wall of the feed element 14 extends upwards as far as an edge 23, angled against the horizontal, of which the lowest level lies in the area of a vertical gap 12, located in the cylindrical wall of the feed element and extending longitudinally along it, and the highest level of which lies on the opposite side of the edge. The edge accordingly forms a narrow upper oblique surface, which falls away uniformly from the point with the highest level above the edge to the point with the lowest level. In the installed state, this edge forms a ramp for the tablets Fk, which then, at the point of the lowest level, enter into the positioning shaft 3 formed by the gap, where the inlet aperture 31 for this shaft is located (FIG. 5*a*). The width of this edge, which is determined by the wall thickness of the feed element at this point, is preferably only a little larger than the size of the tablets, such that the tablets can lie only in one layer on the ramp-shaped edge. This leads to an advantageous self-organization of the tablets in the storage space 10 above this edge. The positioning shaft exhibits a square cross-section, which is slightly larger than the tablets which are to be guided through it, such that the tablets can be relied on not to become jammed in the shaft. Inasmuch as the feed element is in contact on the inner side 11 of the metering housing, the gap in the feed element is closed to the outside over its longitudinal direction by this inner side. Due to the fact that the feed cone 22 is also in contact on the inner side of the wall of the feed element in the cut-out 21, the gap is also closed on the inner side. In this way, the positioning shaft is formed, the inlet aperture of which is located at the height of the said ramp, and the outer aperture 32 (output point) of which is located directly above the inwards projecting accommodation edge 19.

The feed cone 22 is inserted into the upper cylindrical cut-out 21 of the feed element 14 (FIG. 2) and connects with the lower edge of its cone roof directly at the circumferential ramp edge 23 of the feed element. Due to the inclined arrangement of the ramp edge 14, the roof surface is not exactly conical, but composed of several part conical surfaces with different inclinations, in order for the lower edge of the roof to close off with the ramp edge. The roof surface of the feed cone therefore falls away as far as this without any step formation. Due to the inclination of the upper edge of the feed element, the roof of the feed cone is therefore also formed asymmetrically. Let into the tip 24 of the feed cone is an indentation 33 for a holding element of a rotation damper 9 (FIG. 3*b*). The axis of rotation 34 of the rotation damper 9 is held in a torsionally resistant manner in this indentation. The rotation damper is further held by means of a bridge 79 at a level above the feed cone at the inner wall 11 of the metering housing 4 (FIG. 1*b*), such that a rotation of the metering housing 4 against the unit of the application housing 6, feed element 14, and feed cone 22, is damped by means of the rotation damper. The structure of the rotation damper is shown in FIG. 10. A rotationally symmetrical base part 35 forms the bridge, which is secured to the inner side of the metering housing. This base part 35 is formed by a base plate 36, which comprises a cage element 37. The cage element surrounds a likewise rotationally symmetric inner plate 38, essentially freely movable. The inner plate is located on the inner surface of the base part. Located between the inner surface of the base part and the side of the inner plate facing this inner surface is a fluid film 39 of highly viscous silicone oil. In the event of a relative rotational movement of the base plate towards the inner plate, this film creates a shear force, which counteracts the torque causing the rotation. As a result, the rotational movement is compensated for, and, in particular, the rotational acceleration is reduced.

The inner side 11 of the metering housing 4 is not smooth but is provided with vertical serration 40 (FIG. 4), which extends over the wall side projecting upwards over the feed element 14. Tablets Fk which fall into the space above the feed cone 22 form a bulk body in this storage space 10, which is in contact with the wall of the metering housing. Due to the rotation of the metering housing in relation to the feed cone, the tablets in contact with the metering housing wall are set into a vibration movement, such that they align themselves in an arrangement which favours entry into the positioning shaft 3. The vibration movement causes the tablets to be conveyed through the gap 25 between the inner side of the metering housing and the cover of the feed cone, and the inclined ramp-shaped edge 23 of the feed element 14, in the direction of the lowest level point, and they are accordingly introduced into the positioning shaft 3 formed by the gap 12 in the feed element. To this extent, the area of the storage space located directly above this ramp-shaped edge can be regarded as a feed space.

The accommodation apertures 5 form a circular row, arranged coaxially to the axis of rotation 2 of the metering housing 4, in the accommodation wall 19 of the metering housing (FIG. 7). This row extends at least over a segment of a circle and comprise, for example, 16 accommodation apertures. These represent cylindrical passage apertures of the accommodation edge.

Figure 5B:
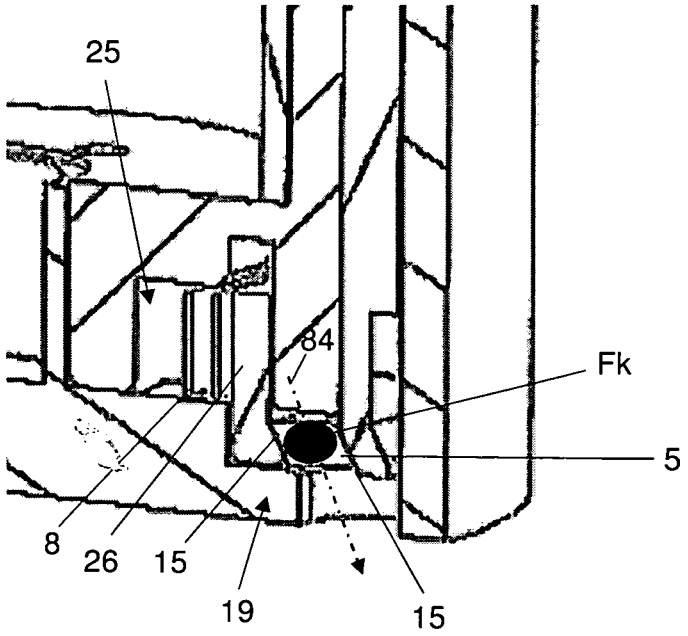

Located on a base plate 16 in the application housing 6 is an application aperture 7, from which the tablets Fk are output (FIGS. 1*b*, 5*b*, 7). For this purpose, this aperture penetrates the base plate 16 of the application housing completely, and connects the interior of the dispensing device 1 with its surroundings. The application aperture can be either a little larger or perceptibly larger than the accommodation apertures 5 in the metering housing 4. It is located on a circle coaxial to the axis of rotation 2, with the same circle diameter as the accommodation apertures, such that, by suitable rotation of the metering housing in relation to the application housing, the accommodation apertures can be arranged in alignment with the application aperture. Otherwise, the inner surface 41 of the application housing closes the accommodation apertures downwards (FIG. 5A), such that tablets contained in these accommodation apertures cannot fall out.

The inner sides 15 of the accommodation apertures 5 are, in the radial direction, inclined downwards and outwards, such that their axes 84 are inclined against the vertical. As a result, at the more rapid rotation of the metering housing 4, in particular during the backwards movement forced by the helical leaf spring 8, tablets Fk contained in the apertures are thrown by centrifugal force outwards and downwards, and, on passing the application aperture 7, through this and out of the dispensing device 1.

For a use of the dispensing device 1, the metering housing 4 is rotated against the application housing 6 and the feed element 14 and the feed cone 22 in a filling direction of rotation Bd, whereupon the helical leaf spring 8 tensions and the metering housing is set under pre-tension. In order for the metering housing, in this position, not to revert by itself to the starting position under the spring tension, a detent arrangement in the form of a tooth arrangement 80 is formed in the outer wall 18 of the metering housing (FIGS. 2, 8). An actuating cam 81 of an actuating slide piece 43 engages in this tooth arrangement, and then, if the actuating slide piece is not actuated, prevents the rotation of the metering housing in an output direction of rotation Ad. The blocking of the backwards movement in the output direction of rotation Ad can be suspended by means of an actuating slide piece 43 at the application housing 6, in that this is moved downwards, out of the engagement position in the tooth arrangement, whereupon the helical leaf spring rotates the metering housing back into the starting position. In order that, when rotating back, the metering housing does not rotate back beyond the starting position, a block 82, formed underneath at the metering housing, runs in an annular slot 83 in the base 16 of the application housing 6. On the starting position being reached, this block strikes one end of the annular slot (FIG. 9). The actuating slide piece itself is held by means of a tension spring 44 in a position of rest (FIG. 2), in which it blocks the backwards movement. Against the effect of the tension spring, the actuating slide piece is defected downwards, in order to suspend the blocking. After the backwards movement has been initiated, the actuating slide piece can be released again, such that it moves back into its position of rest again, under the effect of the tension spring. The backwards movement of the metering housing is then again blocked.

Also located in the application housing 6 is an indexing aperture 45, by which the relative position between the application housing and the metering housing 4 can be read off in the form of position figures. These figures are applied on the outer wall of the metering housing (FIG. 6). The position figures indicate the number of tablets Fk which have fallen into the accommodation apertures 5 in the metering housing due to the rotation.

The function of the dispensing device 1 in the embodiment variant is explained in greater details in FIGS. 6, 7.

To fill the dispensing device 1 with tablets Fk, a primary packaging means, such as a tablet bottle Fl, containing a plurality of tablets, such as microtablets with a size of, for example, 2 mm, is screwed onto the connection ring 20 of the dispensing device, after its top has been unscrewed. By upending the bottle, such that it points upwards and the application aperture 7 is directed downwards, the tablets fall into the dispensing device and fill the storage space 10, including the feed space, completely, by forming a bulk body of tablets. In this situation, the tablets also completely fill the positioning shaft 3. This serves to align the tablets with one another, such that they can pass one after another via an output point, the output aperture 32, individually into the accommodation apertures 5.

In the starting position, it can be read off in the indexing aperture 45 in the application housing, that no tablets Fk have yet fallen into the accommodation apertures 5. By rotating the metering housing 4 against the application housing in the marked filling direction of rotation Bd, tablets fall one after another out of the positioning shaft 3 into the accommodation apertures and are therefore fed to these, wherein, one after another, the number of the filled accommodation apertures can be read off by means of a corresponding number via the indexing aperture. From FIG. 7 it can accordingly be seen that, first, a first tablet falls out of the shaft into a first accommodation aperture 5.1, as soon as this is brought into congruency with the shaft as a result of the rotation. With further rotation, further tablets can fall into following accommodation apertures 5.2, . . . , such that, finally, a specific number of accommodation apertures are filled with this number of tablets. When the metering housing is rotated into the filling direction of rotation Bd, the accommodation apertures are closed downwards by the application housing. The tablets are therefore held in the accommodation apertures. As soon as the desired number of tablets have been accommodated in accommodation apertures, the metering housing is not rotated any further. Due to the rotation of the metering housing against the non-rotatable component parts of the dispensing device 1, the helical leaf spring 8 is subjected to preliminary tension. In this rotational position, however, the metering housing remains stationary, since the mutual relative rotation is blocked. Only by release by means of the actuating slide piece 43 can the energy stored in the spiral leaf spring be built up again, in that the metering housing rotates in the output direction of rotation Ad, wherein the rotational acceleration and speed of this backwards rotation are compensated by the rotation damper 9. During the backwards rotation, on the one hand, on the way back any accommodation apertures which were not yet filled will be now filled. On the other hand, the filled accommodation apertures now pass over the application aperture 7, such that the tablets are released downwards and the accommodation apertures are emptied accordingly. The tablets can, for example, be transferred directly into a glass. As an alternative, it is also possible for a catchment container to be additionally attached from beneath by way of the application housing, into which the tablets are output and from which they can subsequently be taken.

Thanks to the unambiguous read-off facility of the number of the tablets Fk transferred into the accommodation apertures 5, a reliable enumeration of the tablets which have been output is achieved. As a result, this dispensing device 1 is extremely well-suited for a reliable discharge of tablets. Due to the fact that the mechanism additionally works very reliably, and no elaborate components are required, such as motor drives or an electronic sensor system, a simple and reliable method of counting is achieved.

Shown in FIGS. 11 to 19 is a second embodiment of the present dispensing device 1. This second embodiment variation is likewise connected to a primary packaging means, such as a pharmaceuticals bottle Fl. To do this, the bottle is screwed into an adapter, in this case a basic body 46, after the top of the bottle has been unscrewed. The dispensing device according to the invention comprises the following component parts: A retaining force 4 with a feed dome 48 and a metering shell 50, the basic body into which the feed dome of the retaining device projects centrally and freely rotatably, a support panel 6 supporting the metering shell from beneath, a tensioning ring 51, which is rotatably connected to the support panel, a spring-loaded release button 53, which is held in the support panel, a helical leaf spring 8, which is supported in the support panel and is connected to the metering shell, a rotation damper 9 for compensating the rotational movement of the retaining device in the support panel, and a filling tilting securing arrangement 54 and an output tilting securing arrangement 55. The outer shape of the dispensing device is essentially formed by the tensioning ring on its underside, the basic body in the middle part, and an setting ring 56 in the upper area. These component parts, like the retaining device, are arranged rotationally symmetrical, and can be arranged coaxially to one another. Accordingly, the dispensing device exhibits an essentially rotationally symmetrical form, with a central axis, which simultaneously also forms the axis of rotation 2 for the retaining device, the tensioning ring, and the setting ring.

The setting ring 56 is connected by a positive-fit connection to the basic body 46, in that detent nose elements 57, with corresponding detent projections 58, engage on the outer side of a screw-in ring 64 of the basic body (FIG. 12). This engagement is arranged in such a way as to allow for a rotation of the setting ring 56 in relation to the basic body. The setting ring is provided with a marking 60, which is shown on an indexing scale 61 on the basic body (FIG. 19). This indexing scale shows the degree of rotation of the setting ring in relation to the basic body, and therefore an advance setting of the desired number of tablets Fk to be output. On the rotation of the setting ring in relation to the basic body, the ring engages in equidistant angle increments, and specifically in such a way that the marking engages at each index mark of the indexing scale. For the advance setting, the setting ring comprises a delimitation nose element 52, extending downwards, with which, at an appropriate relative position of the setting ring in relation to the metering shell 50, a corresponding contact nose element 62 comes in contact (FIG. 19).

The basic body 46 comprises a peripheral outer wall 63, the screw-in ring 64, coaxial to the outer wall, for the tablet bottle Fl, and the feed conduit 59, connected to the screw-in ring by way of a lower horizontal connection ring plate 65 (FIG. 17). These three components are set up rotationally symmetrically and arranged coaxially to one another. On the inner side of its screw-in ring, the basic body comprises an internal thread for the neck screw thread of the bottle to be screwed into. The feed conduit comprises on its inner side a trough 12, which is located on the inner side of the feed conduit projecting inwards, and, from the top, first runs vertically downwards, then in its further course runs along the cross-section extension of the basic body, moving outwards from the inner side of the feed conduit in a curved path (FIG. 13). The trough has an essentially square cross-section.

The basic body 46 is located with the lower edge of its peripheral outer wall 63 on a ring-shaped mount 66 on the tensioning ring 51. The support panel 6 is mounted in the interior space between the basic body and the tensioning ring. The retaining device 4 is rotatably mounted between the support panel and the basic body 46. The retaining device is located coaxially with its metering shell 50 on the support panel and projects with its feed dome 48 through the feed conduit 59 of the basic body. The outer side of the feed dome and the upper side of the metering shell are in contact with the edges of the trough 12 of the basic body, and close this off in the longitudinal direction, such that a positioning shaft 3 is thereby formed (FIG. 13). The positioning shaft opens with its outlet aperture 32 (output point) into accommodation apertures 5 in the metering shell of the retaining device (FIG. 16).

The accommodation apertures 5 in the metering shell 50 are circular passage apertures, which are arrayed on an orbit with the diameter indicated, about the axis of rotation 2 of the retaining device (FIG. 15). The metering shell contains 16 accommodation apertures, which are arranged distributed equidistant from one another over a segment of a circle of the metering shell. By the rotation of the retaining device in relation to the trough 12 on the basic body 46, in each case an accommodation aperture can be arranged in alignment above the output aperture 32 of the positioning shaft 3. The accommodation apertures which are not brought into congruency with the outlet aperture of the positioning shaft are closed off downwards by means of an annular panel 67 on the basic body (FIGS. 14, 16). This annular panel extends in ring fashion downwards in the plane of rotation adjacent to the outlet aperture at the trough on the underside of the basic body, and reaches as far as just above the accommodation apertures 5, such that tablets Fk located in them cannot fall out.

The accommodation apertures 5 are closed off downwards by an upper side 41 of the support panel 6 arranged beneath the metering shell 59, extending over a segment of a circle, such that the tablets Fk cannot fall out (FIG. 17). With appropriate rotation of the metering shell, however, the accommodation apertures are moved over an application aperture 7 in the support panel, such that they can be emptied downwards. FIG. 20 shows accommodation apertures 5 in the metering shell and two tablets Fk, one of which is in the process of coming out of the positioning shaft 3, via its outlet aperture 32, and passing into an accommodation aperture, and another is falling outwards through the application aperture. The application aperture extends over an angle range which is exactly as great as the angle range adopted by the row of accommodation apertures. Accordingly, when appropriately positioned, in each case a plurality of accommodation apertures are placed above the application aperture. This allows for reliable issue of the tablets from the accommodation apertures themselves, even with very rapid backwards rotation of the retaining device 4, because the accommodation apertures, during the backwards rotation of the retaining device, are open downwards for a relatively long period of time. Located in the tensioning ring 51 is a dispensing aperture 68, extending over the same angle range as the application aperture in the support panel, which is arranged offset radially somewhat inwards in relation to the application aperture (FIG. 17). Because the tensioning ring is rotated in synchrony with the retaining device, this dispensing aperture is always located beneath the segment of the circle adopted by the accommodation apertures.

The inlet aperture 31 in the positioning shaft 3 lies in an indentation in an annular gap 25 between the feed conduit 59 and the feed dome 48 of the retaining device 4 (FIG. 12). This annular gap is formed laterally by the outer side 11 of the feed dome and the inner side 47 of the feed conduit 59, which form two wall surfaces running parallel to one another. The annular gap is delimited downwards by an inclined ramp 23 at the feed conduit, the lowest point of which is formed by the inlet aperture 31 into positioning shaft 3. The point with the highest level of the inclined ramp is located directly opposite the inlet aperture. The ramp is therefore formed by a narrow inclined surface, which falls away uniformly from the point with the highest level to the point with the lowest level, where the tablets Fk enter into the positioning shaft.

The upper part of the feed dome 48 is not smooth, but provided with a vertical serration 40, which extends essentially over the free-standing wall height above the lowest point of the tablet ramp 23 (FIG. 12). Additionally, the feed dome is formed cone-shaped at the tip. Its outer side is likewise formed as roughened, and for this purpose provided with knobs 40. Tablets which are fed into the space above the feed dome form a bulk body in the storage space 10 formed there, which is in contact with the wall of the feed dome. Due to the rotation of the retaining device 4 in relation to the basic body 46, and therefore in relation to the feed conduit 59, the tablets Fk in contact with the wall of the feed dome are set into a vibration movement, such that they align themselves in a favourable arrangement. Due to the gap 25 between the inner side 47 of the feed conduit and the feed dome and the inclined tablet ramp in the annular gap, the tablets are conveyed by the vibration movement further in the direction towards the point of the lowest level, and are therefore fed into the positioning shaft 3 formed by the trough 12 in the basic body. To this extent, the area of the storage space lying directly above this tablet ramp can be regarded as a feed space.

Located in the support panel 6, in a central spring chamber 69 which is formed by an annular chamber wall 70, is the helical leaf spring 8, and secured there (FIG. 17). The metering shell 50 is located above the spring chamber and is likewise connected to the helical leaf spring. Additionally, installed beneath the spring chamber and coaxially to the axis of rotation 2 of the retaining device 4, is a rotation damper 9, which is connected by way of its base part to the support panel 6. With regard to the function and arrangement of the rotation damper, reference is made to the corresponding description of the first embodiment variation (FIG. 10). The retaining device is connected in a torsionally-resistant manner to the rotation axle 34 of the rotation damper.

The tensioning ring 51 is connected to the support panel 6 by means of a detent ratchet arrangement, wherein this ratchet arrangement allows for a rotation of both components in relation to one another. The tensioning ring comprises a thrust block 85, projecting upwards, which comes in contact with a carrier dog 86 projecting upwards on the metering shell (FIG. 20). The rotation of the tensioning ring therefore also causes the retaining device 4 to rotate. In this situation the helical leaf spring 8 is under preliminary tension. In order for the retaining device 4 not to rotate back out of the pre-tensioned position by itself, a tooth arrangement 71 is located, section by section, on the underside of the metering shell, this tooth arrangement engaging with a spring arm 72 of the release button 53 (FIG. 21). Accordingly, the spring arm of the release button and the tooth arrangement extending over a segment of a circle are spaced equidistant from the rotation axle 2 for the retaining device 4. As a result of the tooth arrangement, the backwards movement is blocked. The release button extends radially in the area of the support panel 6 and projects outwards, such that it can be actuated manually. The button is formed by an operating element 73 located on the outside, and a sensor arm 74 moulded to this. The sensor arm engages around the wall 70 of the spring chamber 69, and is thereby held in the support panel, wherein the radial position of the sensor arm is freely movable over a radial button path. The sensor arm is actuated against the tension of a pressure spring arranged in the area of the operating element. The sensor arm contains the spring arm 72, which, due to the actuation, is disengaged from the area of the tooth arrangement 71 on the underside of the metering shell 50, and therefore allows for the backwards rotation of the retaining device 4.

The dispensing device 1 according to this embodiment variant further comprises a filling tilting securing arrangement 54. For this purpose, located beneath the support panel 6, in the annular chamber formed by the tensioning ring 51, are three ball paths 5, which run in a radial direction, and which are formed falling away to the centre of the tensioning ring, such that the balls 76 running in them are located, in a basic orientation of the dispensing device, at the lowest point of the device (FIG. 17). If the dispensing device is tilted, one or more of these balls can roll on their paths to higher placed locations, and in this position block the rotation of the locking ring. This takes place by way of a chicane which is formed on the underside of the support panel and points downwards, on which the balls run. Due to the uniform distribution of these ball paths about the axis of rotation 2, a blocking of the rotation of the retaining device 4 can therefore also be attained even with tilting in different spatial directions. The filling tilting securing arrangement serves to ensure that the tablets Fk located in the storage space 10 above the positioning shaft 3 pass reliably into the positioning shaft and from there into the accommodation apertures 5. This would not happen with the dispensing device not being in a perpendicular, or close to perpendicular position.

The dispensing device 1 further comprises an outlet tilting securing arrangement 55. This device, like the filling tilting securing arrangement, is formed by a ball path 77 with a ball 78 running in it, in the area of the release button 53 (FIG. 18). This ball path runs transversely to the direction of movement of the release button, and exhibits a middle lowest level and higher levels at the sides. The release button comprises on the underside a chicane, projecting downwards, with a middle free section which extends transversely to the direction of movement of the release button. The free section in this chicane is located at the point of the lowest level of the ball path. When the dispensing device adopts a perpendicular or close to perpendicular position, the balls running in the path move into the middle lowest position. In this position, the release button can be actuated in the radial direction, because the balls can pass through the free section of the chicane. As a result, the spring arm 72 of the release button can disengage from the tooth arrangement 71 on the metering shell 50 and release the backwards rotation in the output direction of rotation. By contrast, if the dispensing device is not held perpendicular, or not at least close to perpendicular, the ball rolls in a lateral direction to one side. As a result, when the release button is pressed in, the chicane is moved against the ball, such that this blocks further actuation.

To fill the dispensing device 1 of this second embodiment variant with tablets Fk, a primary packaging means, such as a tablet bottle Fl, which contains a plurality of tablets, such as microtablets, is screwed onto the setting ring 56 of the dispensing device, after its top has been unscrewed. By tipping the bottle so that it faces upwards and the application aperture 7 is pointing downwards, the tablets fall into the dispensing device and completely fill the storage space 10, including the feed space in the annular gap 25 between the outer wall side 11 of the feed dome 48 and the inner wall side of the feed conduit 59 above the positioning shaft 3. There they form a tablet bulk body. In this situation, the tablets also completely fill the positioning shaft. This serves to align the tablets with one another.

In order to determine a specific number of tablets Fk to be dispensed, first the setting ring 56 is rotated in relation to the basic body 46, such that the marking 60 on the setting ring for the desired number of tablets points to the corresponding index mark on the indexing scale 61 on the basic body. Due to this rotation, the delimiting nose element 52 on the setting ring is set to a specific angle setting, until the stop nose element 62 on the metering shell 50 can be rotated in the filling direction of rotation Bd. On the subsequent rotation of the tensioning ring 51, the metering shell is moved in sympathy in the filling direction of rotation Bd, because the thrust block at the tensioning ring comes in contact with the carrier dog of the metering shell, and the metering shell is therefore likewise rotated in sympathy in the filling direction of rotation. In this situation, tablets Fk fall one after another out of the positioning shaft 3 into the accommodation apertures 5 in the metering shell, and are therefore guided to these, since, with this direction of rotation, the accommodation apertures pass the outlet aperture 32 of the positioning shaft. Accordingly, initially one first tablet falls out of the shaft into a first accommodation aperture of the row of accommodation apertures, as soon as this is brought into congruency with the shaft due to the rotation: On further rotation, further tablets fall into subsequent accommodation apertures, such that, finally, a specific number of accommodation apertures are filled with this number of tablets. On the rotation of the metering shell in the filling direction of rotation, the accommodation apertures run on the upper side 41 of the support panel 6, and are therefore closed off downwards. The tablets are therefore held in the accommodation apertures. The tensioning ring cannot be rotated beyond a preselected angle range, however, since then the metering shell being moved in sympathy engages with its contact nose element on the delimiting nose element of the setting ring, in its preselected position, such that a further rotation in the filling direction of rotation is blocked.

On the rotation of the retaining device 4 in the filling direction of rotation Bd, the helical leaf spring 8 is tensioned. Since a rotation of the retaining device in the opposite direction of rotation Ad cannot take place due to the engagement of the spring arm 72 of the release button 53 in the tooth arrangement 71 on the underside of the metering shell 50, the output of the tablets Fk from the output apertures 5 is only possible when the release button is actuated, so that this block is suspended. By the actuation of the release button, the energy stored in the helical leaf spring can be dispersed again, in that the retaining device rotates over the support panel 6, wherein the rotation acceleration and speed of this backwards rotation is reduced by the rotation damper 9, and therefore compensated for. During the backwards rotation, on the one hand the accommodation apertures not yet filled on the outward movement will now be filled subsequently. On the other hand, the filled accommodation apertures now pass over the application aperture 7 in the support panel, such that the tablets are dispensed downwards and the accommodation apertures emptied accordingly. The tablets can, for example, be transferred directly into a glass. As an alternative, it is also possible for a catchment container to be additionally attached from below by means of the tensioning ring, into which the tablets Fk are dispensed and from which they can later be taken.

With this second embodiment variant of the dispensing device 1 according to the invention, a simple and reliable device is provided. This device functions entirely without motor drives or electronic sensors, and is therefore economical in manufacture, in use, and in subsequent disposal. As well as this, this device is extremely reliable in operation, since the number of tablets which has been set will be reliably dispensed. Presetting is convenient and guarantees reliable operation.

REFERENCE NUMBER LIST

1 Dispensing device
2 Axis of rotation
3 Positioning device, positioning shaft
4 Retaining device, metering housing
5, 5.1, 5.2 Retaining means, accommodation aperture
6 Output device, application housing, support panel
7 Application aperture
8 Elastic element, helical leaf spring
9 Rotation damper
10 Storage space
11 Inner side of retaining device, outer side of feed dome
12 Trough, gap
13 Outer side of the feed element
14 Feed element

15 Wall of accommodation aperture
16 Base plate of application housing
17 Casing, side wall of application housing
18 Wall of metering housing
19 Accommodation wall
20 Connection ring
21 Cylindrical cut-out in feed element
22 Feed cone
23 Upper edge of feed element, inclined ramp in feed conduit of the basic body
24 Tip of feed cone
25 Annular gap
26 Support tab
27 Support connection
28 Guide connection
30 Base plate of feed element
31 Inlet aperture into the positioning shaft
32 Output point, outlet aperture from the positioning shaft
33 Indentation in feed cone
34 Axis of rotation damper
35 Base part of rotation damper
36 Base plate of rotation damper
37 Cage element of rotation damper
38 Inner plate of rotation damper
39 Liquid film of silicone oil
40 Serration on inner side of retaining device, knobs on feed dome
41 Inner surface of output device and of application housing, upper side of support panel
42 Socket on base plate of application housing
43 Actuating slide piece
44 Tension spring at actuating slide piece
45 Indexing aperture
46 Basic body
47 Inner wall of basic body
48 Feed dome of retaining device
49 Outer wall side of feed dome
50 Metering shell of retaining device
51 Tensioning device, tensioning ring
52 Stop, delimiting nose at setting ring
53 Release button
54 Filling tilting securing arrangement
55 Output tilting securing arrangement
56 Setting ring
57 Detent nose element at setting ring
58 Detent projection on basic body
59 Feed conduit of basic body
60 Marking on setting ring
61 Indexing scale on basic body
62 Stop nose element on metering shell
63 Outer wall of basic body
64 Screw-in ring
65 Horizontal connection ring plate
66 Mount on tensioning ring
67 Annular panel on basic body
68 Dispensing aperture in tensioning ring
69 Central spring chamber
70 Spring chamber wall
71 Tooth arrangement on metering shell
72 Spring arm of release button
73 Operating element of release button
74 Sensor arm of release button
75 Ball path of filling tilting securing arrangement
76 Ball of filling tilting securing arrangement
77 Ball path of output tilting securing arrangement
78 Ball of output tilting securing arrangement
79 Bridge for securing rotation damper
80 Tooth arrangement on metering housing
81 Actuation stop on actuation slide piece
82 Block
83 Annular slot
84 Axis of accommodation aperture
85 Thrust block
86 Carrier dog
Ad Output direction of rotation
Bd Filling direction of rotation
Fk Solid portion, tablet
Fl Primary packaging means, bottle

The invention claimed is:

1. A dispensing device for solid portions present in a bulk body, wherein the dispensing device comprises the following components:

(a) a positioning device, in which the solid portions are arranged in a row, and
(b) a retaining device with at least one retaining means in the form of a respective accommodation aperture for accommodating a respective one of the solid portions,
(c) wherein the retaining device is designed such as to hold the solid portions above the positioning device in a storage space in the bulk body,
(d) wherein a wall inner side and/or wall outer side of the retaining device, with which the solid portions are in contact, is profiled, in order that, on a movement of the retaining device in relation to the positioning device from the wall inner side and/or wall outer side with which the solid portions are in contact, movement pulses are transferred to the solid portions,
(e) wherein the positioning device and the at least one retaining means are movable relative to one another, such that the positioning device and the at least one retaining means can be aligned flush with one another, and the at least one retaining means can be filled by means of the positioning device with a respective one of the solid portions portion, and
(f) wherein, for the output of the solid portions, the at least one retaining means can be emptied by a movement of the retaining device;
(g) wherein the dispensing device exhibits an axis of rotation, that the retaining device comprises at least two retaining means, that the at least two retaining means are arranged coaxially to the axis of rotation, that the positioning device and the at least two retaining means are movable coaxially to the axis of rotation relative to one another, and that the at least two retaining means can be emptied to dispense the solid portions by a rotation of the retaining device.

2. The dispensing device in accordance with claim 1, characterised in that the positioning device is formed by a positioning shaft, in which the solid portions can be removed from the bulk body, and in which a column of solid portions can be formed, stacked above one another.

3. The dispensing device in accordance with claim 2, wherein at least one of the two retaining means comprises an application housing, characterised in that the at least two retaining means are formed by a respective accommodation aperture, which can be closed downwards by the application housing, or is open downwards by way of an application aperture in the application housing, wherein the retaining device can be rotated in relation to the application housing and the positioning device.

4. The dispensing device in accordance with claim 2, characterised in that the retaining device can be rotated by means of an elastic element into a pre-tensioned rotation position, in order to fill the at least two retaining means with a respective one of the solid portions, and that the retaining device can be rotated from the pre-tensioned rotation position into a rotation position in which the elastic element is relaxed, in order to dispense the respective solid portions located in the at least two retaining means out of the dispensing device.

5. The dispensing device in accordance with claim 2, characterised in that the dispensing device comprises a movement damper in order to compensate for the movement of the retaining device.

6. The dispensing device in accordance with claim 1, wherein at least one of the two retaining means comprises an application housing, characterised in that the at least two retaining means are formed by a respective accommodation aperture, which can be closed downwards by the application housing, or is open downwards by way of an application aperture in the output device, wherein the retaining device can be rotated in relation to the application housing and the positioning device.

7. The dispensing device in accordance with claim 6, characterised in that the retaining device can be rotated by means of an elastic element into a pre-tensioned rotation position, in order to fill the at least two retaining means with a respective one of the solid portions, and that the retaining device can be rotated from the pre-tensioned rotation position into a rotation position in which the elastic element is relaxed, in order to dispense the solid portions located in the at least two retaining means out of the dispensing device.

8. The dispensing device in accordance with claim 1, characterised in that the retaining device can be rotated by means of an elastic element into a pre-tensioned rotation position, in order to fill the at least two retaining means with a respective one of the solid portions, and that the retaining device can be rotated from the pre-tensioned rotation position into a rotation position in which the elastic element is relaxed, in order to dispense the solid portions located in the at least two retaining means out of the dispensing device.

9. The dispensing device in accordance with claim 8, wherein at least one of the two retaining means comprises an application housing, characterised in that the positioning device is formed by a trough at or in the outer side or by a gap in the outer wall of a feed element, and an inner side, closing off the trough or the gap, of a metering housing, which accommodates within it in a rotatable manner the feed element and forms the retaining device, that at least two accommodation apertures are arrayed in the metering housing along an orbit path running coaxially to the axis of rotation, and that the at least two accommodation apertures can be closed downwards by the application housing, or are open downwards by way of an application aperture in the application housing.

10. The dispensing device according to claim 8, wherein at least one of the two retaining means comprises an application housing, characterised in that the dispensing device comprises a tensioning device for rotating the retaining device between a rotating position in which the retaining device is under pre-tension, and a rotating position in which the retaining device is relaxed, and that the rotation of the tensioning device can be delimited by a pre-adjustable stop, such that a filling of the accommodation apertures of the metering shell with the solid portions is limited to a predetermined number; and in that the positioning device is formed by a trough at or in the inner side of a basic body and an outer side, closing off the trough or the gap, of a feed dome, accommodated therein in a rotatable manner by the basic body, of a retaining device which also comprises a metering shell, that at least two accommodation apertures are arrayed in the metering shell along an orbit running coaxially to the axis of rotation, and that the at least two accommodation apertures can be closed downwards by the application housing formed by a support panel, or are open downwards through an application aperture in the support panel.

11. The dispensing device in accordance with claim 1, characterised in that the dispensing device comprises a movement damper in order to compensate for the movement of the retaining device.

12. The dispensing device in accordance with claim 1, wherein at least one of the two retaining means comprises an application housing, characterised in that the positioning device is formed by a trough at or in the outer side or by a gap in the outer wall of a feed element, and an inner side, closing off the trough or the gap, of a metering housing, which accommodates within it in a rotatable manner the feed element and forms the retaining device, that at least two accommodation apertures are arrayed in the metering housing along an orbit path running coaxially to the axis of rotation, and that the at least two accommodation apertures can be closed downwards by the application housing, or are open downwards by way of an application aperture in the application housing.

13. The dispensing device according to claim 1, wherein at least one of the two retaining means comprises an application housing, characterised in that the positioning device is formed by a trough at or in the inner side of a basic body and an outer side, closing off the trough or the gap, of a feed dome, accommodated therein in a rotatable manner by the basic body, of a retaining device which also comprises a metering shell, that at least two accommodation apertures are arrayed in the metering shell along an orbit running coaxially to the axis of rotation, and that the at least two accommodation apertures can be closed downwards by the application housing formed by a support panel, or are open downwards through an application aperture in the support panel.

14. The dispensing device in accordance with claim 1, characterised in that the dispensing device comprises a movement damper in order to compensate for the rotational movement of the retaining device.

15. The dispensing device in accordance with claim 1, wherein at least one of the two retaining means comprises an application housing, characterised in that the positioning device is formed by a trough at or in the outer side or by a gap in the outer wall of a feed element, and an inner side, closing off the trough or the gap, of a metering housing, which accommodates within it in a rotatable manner the feed element and forms the retaining device, that at least two accommodation apertures are arrayed in the metering housing along an orbit path running coaxially to the axis of rotation, and that the at least two accommodation apertures can be closed downwards by the application housing, or are open downwards by way of an application aperture in the application housing.

16. A method for the dispensing of solid portions present in a bulk body by means of a dispensing device according to claim 1, comprising:

(a) forming a bulk body of the solid portions in a storage space, (b) positioning of the solid portions at an outlet point by means of a positioning device, which is arranged beneath the storage space, (c) transferring of a respective one of the solid portions from the output point of at least one retaining means in the form of a respective accommodation aperture in a retaining device by the movement of the positioning device and of the at least one retaining means relative to one another, (d) transferring of movement pulses from a wall inner side and/or wall outer side, with which the solid portions are in contact, defining the storage space, onto the solid portions in contact with it, when the retaining device is moved relative to the positioning device, and (e) output of the at least one solid portion from the dispensing device by the movement of the retaining device, such that the at least one retaining means is emptied.

17. The dispensing device in accordance with claim 1, characterised in that the positioning device is formed by a positioning shaft, in which the solid portions can be removed from the bulk body, and in which a column of solid portions can be formed, stacked above one another.

18. A dispensing device for solid portions present in a bulk body, wherein the dispensing device comprises the following components:

(a) a positioning device, in which the solid portions are arranged in a row, and (b) a retaining device with at least one retaining means in the form of a respective accommodation aperture for accommodating a respective one of the solid portions, (c) wherein the retaining device is designed such as to hold the solid portions above the positioning device in a storage space in the bulk body, the retaining device having an application housing, (d) wherein a wall inner side and/or wall outer side of the retaining device, with which the solid portions are in contact, is profiled, in order that, on a movement of the retaining device in relation to the positioning device from the wall inner side and/or wall outer side with which the solid portions are in contact, movement pulses are transferred to the solid portions, (e) wherein the positioning device and the at least one retaining means are movable relative to one another, such that the positioning device and the at least one retaining means can be aligned flush with one another, and the at least one retaining means can be filled by means of the positioning device with a respective one of the solid portions portion, and (f) wherein, for the output of the solid portions, the at least one retaining means can be emptied by a movement of the retaining device; and (g) wherein the positioning device is formed by a trough at or in the outer side or by a gap in the outer wall of a feed element, and an inner side, closing off the trough or the gap, of a metering housing, which accommodates within it in a rotatable manner the feed element and forms the retaining device, that at least two accommodation apertures are arrayed in the metering housing along an orbit path running coaxially to the axis of rotation, and that the at least two accommodation apertures can be closed downwards by the application housing, or are open downwards by way of an application aperture in the application housing.

19. The dispensing device according to claim 18, characterised in that the at least two accommodation apertures respectively comprise at least one wall inclined radially outwards, in order to propel solid portions located therein outside through the application aperture, by means of the rotation of the metering housing.

20. A dispensing device for solid portions present in a bulk body, wherein the dispensing device comprises the following components:

(a) a positioning device, in which the solid portions are arranged in a row, and (b) a retaining device with at least one retaining means in the form of a respective accommodation aperture for accommodating a respective one of the solid portions, the at least one retaining means comprising an application housing, (c) wherein the retaining device is designed such as to hold the solid portions above the positioning device in a storage space in the bulk body, (d) wherein a wall inner side and/or wall outer side of the retaining device, with which the solid portions are in contact, is profiled, in order that, on a movement of the retaining device in relation to the positioning device from the wall inner side and/or wall outer side with which the solid portions are in contact, movement pulses are transferred to the solid portions, (e) wherein the positioning device and the at least one retaining means are movable relative to one another, such that the positioning device and the at least one retaining means can be aligned flush with one another, and the at least one retaining means can be filled by means of the positioning device with a respective one of the solid portions portion, and (f) wherein, for the output of the solid portions, the at least one retaining means can be emptied by a movement of the retaining device; and (g) wherein the positioning device is formed by a trough at or in the inner side of a basic body and an outer side, closing off the trough or the gap, of a feed dome, accommodated therein in a rotatable manner by the basic body, of a retaining device which also comprises a metering shell, that at least two accommodation apertures are arrayed in the metering shell along an orbit running coaxially to the axis of rotation, and that the at least two accommodation apertures can be closed downwards by the application housing formed by a support panel, or are open downwards through an application aperture in the support panel.

21. The dispensing device according to claim 20, characterised in that the dispensing device comprises a tensioning device for rotating the retaining device between a rotating position in which the retaining device is under pre-tension, and a rotating position in which the retaining device is relaxed, and that the rotation of the tensioning device can be delimited by a pre-adjustable stop, such that a filling of the accommodation apertures of the metering shell with the solid portions is limited to a predetermined number.

22. A dispensing device for solid portions present in a bulk body, wherein the dispensing device comprises the following components:

(a) a positioning device, in which the solid portions are arranged in a row, and (b) a retaining device with at least one retaining means in the form of a respective accommodation aperture for accommodating a respective one of the solid portions, the at least one retaining means comprising an application housing, (c) wherein the retaining device is designed such as to hold the solid portions above the positioning device in a storage space in the bulk body, (d) wherein a wall inner side and/or wall outer side of the retaining device, with which the solid portions are in contact, is profiled, in order that, on a movement of the retaining device in relation to the positioning device from the wall inner side and/or wall outer side with which the solid portions are in contact, movement pulses are transferred to the solid portions, (e) wherein the positioning device and the at least one retaining means are movable relative to one another, such that the positioning device and the at least one retaining means can be aligned flush with one another, and the at least one retaining means can be filled by means of the positioning device with a respective one of the solid portions portion, and (f) wherein, for the output of the solid portions, the at least one retaining means can be emptied by a movement of the retaining device;

(g) wherein the positioning device is formed by a positioning shaft, in which the solid portions can be removed from the bulk body, and in which a column of solid portions can be formed, stacked above one another;

(h) wherein the at least two retaining means are formed by a respective accommodation aperture, which can be closed downwards by the application housing, or is open downwards by way of an application aperture in the output device, and wherein the retaining device can be rotated in relation to the output device and the positioning device.

23. A dispensing device for solid portions present in a bulk body, wherein the dispensing device comprises the following components:

(a) a positioning device, in which the solid portions are arranged in a row, and (b) a retaining device with at least one retaining means in the form of a respective accommodation aperture for accommodating a respective one of the solid portions, (c) wherein the retaining device is designed such as to hold the solid portions above the positioning device in a storage space in the bulk body, (d) wherein a wall inner side and/or wall outer side of the retaining device, with which the solid portions are in contact, is profiled, in order that, on a movement of the retaining device in relation to the positioning device from the wall inner side and/or wall outer side with which the solid portions are in contact, movement pulses are transferred to the solid portions, (e) wherein the positioning device and the at least one retaining means are movable relative to one another, such that the positioning device and the at least one retaining means can be aligned flush with one another, and the at least one retaining means can be filled by means of the positioning device with a respective one of the solid portions portion, and (f) wherein, for the output of the solid portions, the at least one retaining means can be emptied by a movement of the retaining device;

(g) wherein the positioning device is formed by a positioning shaft, in which the solid portions can be removed from the bulk body, and in which a column of solid portions can be formed, stacked above one another;

(h) wherein the retaining device can be rotated by means of an elastic element into a pre-tensioned rotation position, in order to fill the at least two retaining means with a respective one of the solid portions, and that the retaining device can be rotated from the pre-tensioned rotation position into a rotation position in which the elastic element is relaxed, in order to dispense the respective solid portions located in the at least two retaining means out of the dispensing device.

* * * * *